US006161490A

United States Patent [19]

Fujinami et al.

[11] Patent Number: 6,161,490

[45] Date of Patent: Dec. 19, 2000

[54] SWIRLING-TYPE MELTING FURNACE AND METHOD FOR GASIFYING WASTES BY THE SWIRLING-TYPE MELTING FURNACE

[75] Inventors: Shosaku Fujinami; Shuichi Nagato; Takahiro Oshita; Shinichirou Chiba, all of Tokyo; Osamu Kameda, Yamaguchi; Toshio Fukuda, Tokyo; Yoshio Kosaka, Yamaguchi, all of Japan

[73] Assignees: Ebara Corporation, Tokyo; Ube Industries, Ltd., Yamaguchi, both of Japan

[21] Appl. No.: 09/254,261

[22] PCT Filed: Sep. 4, 1997

[86] PCT No.: PCT/JP97/03111

§ 371 Date: Apr. 15, 1999

§ 102(e) Date: Apr. 15, 1999

[87] PCT Pub. No.: WO98/10225

PCT Pub. Date: Mar. 12, 1998

[30] Foreign Application Priority Data

| | | | |
|---|---|---|---|
| Sep. 4, 1996 | [JP] | Japan | 8-252261 |
| Dec. 3, 1996 | [JP] | Japan | 8-336271 |
| Apr. 30, 1997 | [JP] | Japan | 9-124772 |

[51] Int. Cl.[7] ..... F23B 5/00; F23G 7/06; F23G 5/12

[52] U.S. Cl. ..... 110/346; 110/213; 110/214; 110/245; 110/259; 110/234

[58] Field of Search ..... 110/210, 213, 110/214, 215, 229, 243, 244, 245, 261, 263, 254, 345, 346, 348, 234; 48/DIG. 2

[56] References Cited

U.S. PATENT DOCUMENTS

| | | | |
|---|---|---|---|
| 4,023,508 | 5/1977 | Cantrell, Jr. et al. | 110/8 |
| 4,279,205 | 7/1981 | Perkins et al. | 110/245 |
| 4,788,918 | 12/1988 | Keller | 110/215 |
| 5,000,098 | 3/1991 | Ikeda et al. | 110/238 |
| 5,050,512 | 9/1991 | Tratz et al. | 110/346 |
| 5,052,312 | 10/1991 | Rackley et al. | 110/346 |
| 5,425,317 | 6/1995 | Schaub et al. | 110/346 |
| 5,573,559 | 11/1996 | Hilliard et al. | 48/203 |
| 5,626,088 | 5/1997 | Hiltumen et al. | 110/243 |
| 5,725,614 | 3/1998 | Hirayama et al. . | |
| 5,782,032 | 7/1998 | Tanaka et al. | 48/77 |
| 5,851,497 | 12/1998 | Brooker et al. | 422/207 |
| 5,900,224 | 5/1999 | Fujimura et al. . | |
| 5,915,309 | 6/1999 | Nakai et al. | 110/214 |

FOREIGN PATENT DOCUMENTS

| | | |
|---|---|---|
| 0676465A1 | 10/1995 | European Pat. Off. . |
| 4435349C1 | 5/1996 | Germany . |
| 59-53592 | 3/1984 | Japan . |
| 3-6443 | 1/1991 | Japan . |
| 4-359991 | 12/1992 | Japan . |
| 6-42731 | 2/1994 | Japan . |
| 7-2456 | 1/1995 | Japan . |
| 7-332614 | 12/1995 | Japan . |
| 8-14363 | 2/1996 | Japan . |
| 10-67992 | 3/1998 | Japan . |
| 10-81885 | 3/1998 | Japan . |
| 10-128288 | 5/1998 | Japan . |

*Primary Examiner*—Denise L. Ferensic
*Assistant Examiner*—Ken B. Rinehart
*Attorney, Agent, or Firm*—Wenderoth, Lind & Ponack, L.L.P.

[57] ABSTRACT

The present invention relates to a swirling-type melting furnace for gasifying combustible wastes and/or coal, and a method of gasifying wastes by the swirling-type melting furnace. In the swirling-type melting furnace (5), gaseous materials supplied to a combustion chamber (6) form a swirling flow which includes an outer swirling flow primarily containing particulate combustibles and an inner swirling flow primarily containing gaseous combustibles. Oxygen is supplied through an inner wall of the combustion chamber (6) to the outer swirling flow primarily containing the particulate combustibles for thereby accelerating gasification of the particulate combustibles.

28 Claims, 15 Drawing Sheets

1
2
3
4
5
6
7
8
9
10
11
12
13
14
15
a + (b)
c + d
e
f
g
h
c
d
i
$g_f$ + j
$g_c$ (a)

(b)

SWIRLING-TYPE MELTING FURNACE AND METHOD FOR GASIFYING WASTES BY THE SWIRLING-TYPE MELTING FURNACE

BACKGROUND OF THE INVENTION

1. Field of the Invention

The present invention relates to a swirling-type melting furnace for gasifying various combustible wastes and/or coal, and a method for gasifying wastes by such a swirling-type melting furnace, and more particularly to a method for treating wastes to achieve thermal recycling, material recycling, and chemical recycling.

2. Description of Related

It has heretofore been customary to treat a considerable amount of wastes such as municipal wastes, waste tires, sewage sludges, and industrial sludges with dedicated incinerators. Night soil and highly concentrated wastes have also been treated with dedicated wastewater treatment facilities. However, large quantities of industrial wastes are still being discarded, thus causing environmental pollution and shortage of landfill sites. There has been a demand for practical use of gasification and slagging combustion systems in which wastes are gasified at a low temperature and then the generated gases are combusted at a high temperature to convert ash content into molten slag and to decompose dioxins completely.

A certain domestic chemical company has already industrialized a technology for producing ammonia from hydrogen which has been produced by gasifying coal. According to this technology, a Texaco-type gasification furnace is used. In the Texaco-type gasification furnace, a coal-water mixture produced by pulverizing coal and mixing the pulverized coal with water is supplied together with oxygen from a downwardly directed burner to gasify the mixture in a single stage at a high temperature of 1500° C. The coal is converted into the coal-water mixture which is of a concentration of about 65% coal, and hence can be gasified stably under a high pressure of 40 atm. The Texaco-type gasification furnace is also used in demonstration plants for combined-cycle power generation systems in the U.S.A. Examples are the Cool Water project at Daggett in California and the Tampa power project at Tampa in Florida.

FIG. 15 of the accompanying drawings shows a coal gasification process employed in the Cool Water project. As shown in FIG. 15, the system for performing the coal gasification process includes a Texaco-type waste-heat-boiler-type gasification furnace 100 having a combustion chamber 106, a slag separation chamber 107, a radiation boiler 108, and a water tank 109. The system further includes a lock hopper 110, a reservoir 111, a screen 112, a convection boiler 113, a scrubber 114, and a reservoir 115. The symbols a, c, d, and g represent a highly concentrated coal-water mixture, oxygen, steam, and slag granules (composed of coarse slag granules $g_c$ and fine slag particulates $g_f$) respectively. Further, the symbols h, i, and j represent generated gas, water, and residual carbon, respectively.

FIG. 16 of the accompanying drawings shows a direct-quench-type gasification furnace as another Texaco-type gasification furnace. In FIG. 16, the direct-quench-type gasification furnace has a burner 101, a throat 102, a guide tube pipe 103, a gas outlet 104, a slag separation chamber 107, a combustion chamber 106, a water tank 109, a slag outlet 116, and a cooling water pipe 117. The symbols a, c, g, and h represent a highly concentrated coal-water mixture, oxygen, slag granules, and generated gas, respectively. Further, the symbols k, m, n, o, and p represent make-up water, wastewater, slag mists, slag layer, and slag droplets, respectively.

The highly concentrated coal-water mixture a is blown together with the oxygen ($O_2$) c from the burner 101 on the top of the furnace into the combustion chamber 106. In chamber, the highly concentrated coal-water mixture a is gasified at a high temperature under a high pressure to generate gas composed mainly of hydrogen ($H_2$), carbon monoxide (CO), carbon dioxide ($CO_2$) and steam ($H_2O$). Ash content in the coal is melted at the high temperature and converted into the slag mists n which are mostly attached to the wall surface of the furnace, thus forming the slag layer o. The slag flowing down in the slag layer o passes through the throat 102, and falls as the slag droplets p into the slag separation chamber 107. The slag mists n that remain in the gas enter into the slag separation chamber 107 through the throat 102 together with the gas. In the slag separation chamber 107, the gas and the slag mists go down in the guide tube 103, and are blown into water in the water tank 109 and cooled therein. After the gas is cooled to a saturation temperature of the water under the conditions at that time, it is discharged from the gas outlet 104. The slag granules g which have been water-quenched into a glass-like material are deposited on the bottom of the water tank 109, and then discharged from the slag outlet 116. The water in the water tank 109 is discharged as the wastewater m into a discrete settler (not shown).

According to the process of gasifying wastes at a low temperature and then gasifying them at a high temperature, the high-temperature gasification furnace at the subsequent stage suffers the following problems: The gas supplied from the low-temperature gasification furnace to the high-temperature gasification furnace contains combustible gas such as hydrogen or carbon monoxide having a high combustion rate and char having a very low combustion rate. Therefore, when the gas is contacted with oxygen, the combustible gas having a high combustion rate is selectively partially combusted. Therefore, the conversion ratio of char in to gas is low.

When the gas flows in a direction opposite to gravity, since the slag flows by gravity in a direction opposite of the gas flow, the slag contained in the gas tends to be deposited on the furnace wall to such an extent as to clog the passage of the gas.

It is therefore an object of the present invention to provide a two-stage gasification system comprising a swirling-type melting furnace which is capable of treating various wastes without converting them into a cool-water mixture, having a high load capacity, and producing a relatively small amount of residual carbon.

SUMMARY OF THE INVENTION

In order to achieve the above object, according to the present invention, there is provided a swirling-type melting furnace comprising: a combustion chamber for gasifying or combusting combustible gaseous materials containing particulate solid at a high temperature; and a slag separation chamber for separating and cooling molten slag generated by gasification or combustion, the gaseous materials supplied to the combustion chamber being swirled to form a swirling flow, the swirling flow including an outer swirling flow primarily containing particulate combustibles and an inner swirling flow primarily containing gaseous combustibles, oxygen being supplied through an inner wall of the combustion chamber to the outer swirling flow primarily containing the particulate combustibles, thereby promoting gasification of the particulate combustibles. Further, the swirling flow is directed downwardly.

An introduction section for gaseous materials and oxygen-containing gas which is coaxial with the combustion chamber and has a diameter which is ¼ to ¾, preferably ⅓ to ½, of the diameter of the combustion chamber is provided, and by providing the inlets and nozzles which are directed tangentially to a hypothetical cylinder, the gaseous materials and the oxygen-containing gas supplied thereto form a swirling flow.

Otherwise, combustible gas containing combustible particulate solid is supplied to the introduction section disposed immediately above the combustion chamber and having a diameter smaller than the diameter of the combustion chamber, thereby forming a swirling flow. Under centrifugal forces which are generated, the particulate solid in the gas is concentrated in the vicinity of a wall surface of the introduction section, and supplied to the combustion chamber having a diameter larger than that of the introduction section while the swirling flow is being maintained.

In the high-temperature gasification furnace, two or more nozzles for the oxygen-containing gas may be provided apart from the others on a side of the combustion chamber below the introduction section, or may be provided vertically apart from the others on a side of the combustion chamber. The nozzles may be directed substantially tangentially to a hypothetical circle. The combustion chamber has an internal temperature ranging from 1200 to 1600° C., preferably 1200 to 1500° C., and an internal pressure near normal pressure, i.e. atmospheric pressure; atm, preferably 10 to 40 atm. The oxygen-containing gas blown into the combustion chamber may comprise air or oxygen-enriched air or oxygen, or one of the above gases to which steam or carbon dioxide gas is added. The combustion chamber may be of a boiler structure with water pipes disposed in a furnace refractory.

The slag separation chamber connected to a lower portion of the combustion chamber may have a space between a radiation boiler and a side of the slag separation chamber, and the gas outlet may be provided in an upper portion of a side of the space, with a gas passage between the radiation boiler and a water level in the water tank. Alternatively, the radiation boiler may be submerged in water in the water tank.

Instead of the radiation boiler, guide tube for performing no heat recovery may be used.

A gas flow straightening plate may be disposed at an opening of the outlet of the combustion chamber for suppressing the swirling flow in the slag separation chamber.

DETAILED DESCRIPTION OF THE INVENTION

The present invention will be described in detail with reference to drawings.

Figure 1:
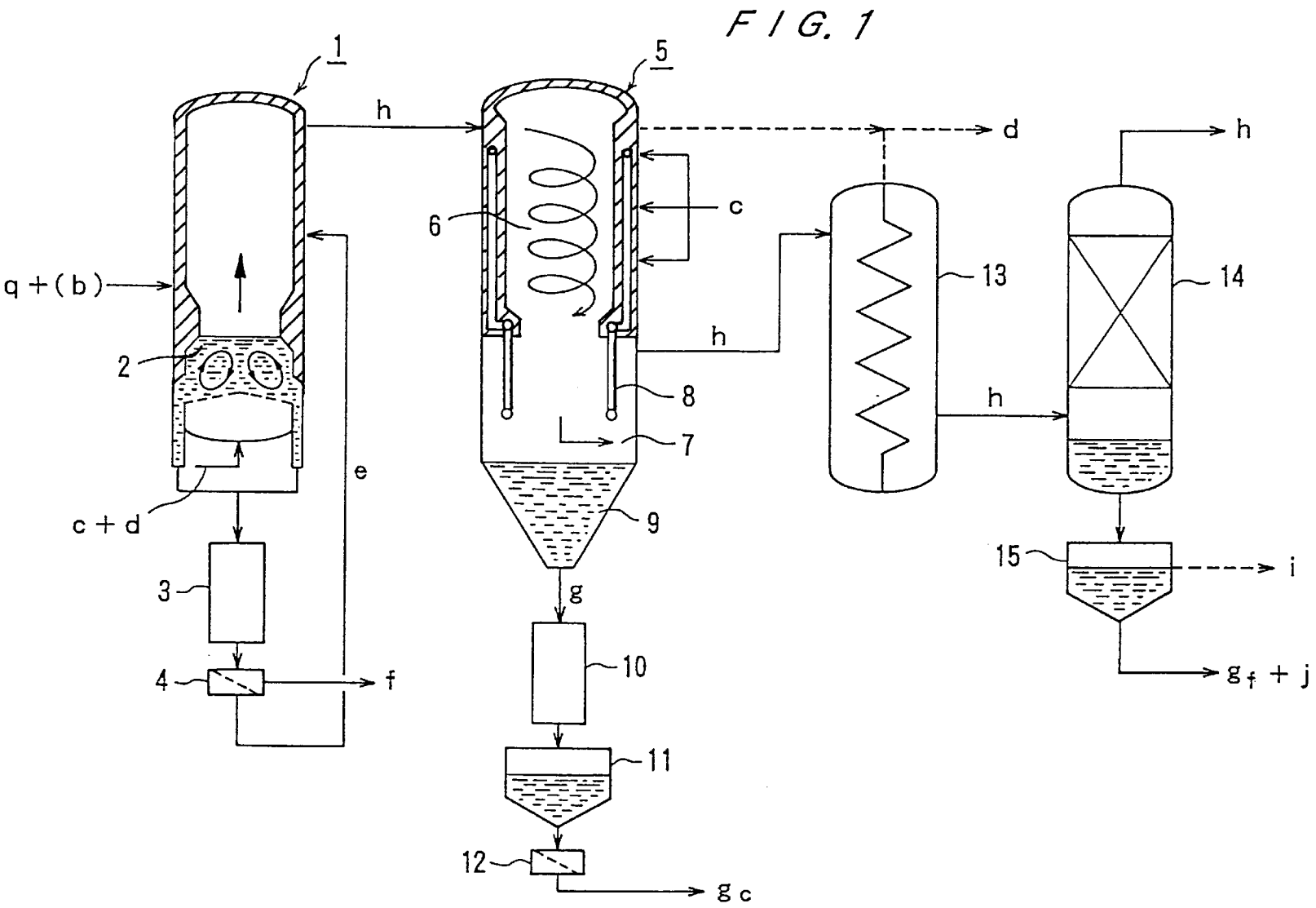
FIG. 1 is a schematic diagram of a gasification system of wastes which incorporates a swirling-type melting furnace according to the present invention.

FIG. 1 shows a two-stage gasification system of wastes which incorporates a fluidized-bed gasification furnace as a low-temperature gasification furnace and a swirling-type melting furnace as a high-temperature gasification furnace according to the present invention. The two-stage gasification system comprises a fluidized-bed gasification furnace 1 having a fluidized-bed 2, a lock hopper 3, a screen 4, a swirling-type melting furnace 5 having a combustion chamber 6, a slag separation chamber 7, a radiation boiler 8 and a water tank 9, a lock hopper 10, a reservoir 11, a screen 12, a convection boiler 13, a scrubber 14, and a reservoir 15. The symbols q, b, c, d, and e represent wastes, coal, oxygen, steam, and sand, respectively. The symbols f, g, h, i, and j represent incombustibles, slag granules (composed of coarse slag granules $g_c$ and fine slag particulates $g_f$), generated gas, water, and residual carbon, respectively.

Combustible wastes that can be treated by the two-stage gasification system shown in FIG. 1 include municipal waste, refuse-derived fuel, solid-water mixture, plastic wastes, FRP wastes, biomass wastes, automobile wastes, and low-grade coal, and the like. The refuse-derived fuel is produced by crushing and classifying municipal wastes, adding quicklime to the classified municipal wastes, and compacting them to shape. The solid water mixture (SWM) is produced by crushing municipal wastes, converting them into a slurry by adding water, and converting the slurry under a high pressure into an oily fuel by hydrothermal reaction. The FRP is fiber-reinforced plastics. The biomass wastes include wastes from water works or sewage plants (misplaced materials, sewage sludges), agricultural wastes (rice husk, rice straw), forestry wastes (sawdust, bark, lumber from thinning), industrial wastes (pulp-chip dust), and construction wastes. The low-grade coal may be peat having a low coalification, or coal wastes which are discharged from coal separation.

The combustible wastes 9 are supplied at a constant rate to the fluidized-bed gasification furnace 1. use of an internal revolving-type fluidized-bed furnace is highly advantageous in that it can be supplied with the combustible wastes in a roughly crushed condition in a preparation process. Since the wastes q vary unavoidably in quality, a certain amount of coal is added to the wastes q for stabilizing operating conditions and gas compositions. The fluidized-bed gasification furnace 1 is supplied with a mixture of oxygen c and steam d as a fluidizing gas. The wastes q and the coal b which are supplied to the fluidized-bed gasification furnace 1 are contacted with a gasifying agent of oxygen c and steam d, then quickly pyrolized and gasified in the fluidized-bed 2 composed of sand e which is kept at a temperature ranging from 550 to 850° C.

The incombustibles f in the wastes q are discharged together with the sand e from the bottom of the fluidized-bed gasification furnace 1, and supplied through the lock hopper 3 to the screen 4. Large incombustibles are separated and removed therefrom by the screen 4. The sand e under the screen 4 is conveyed upwardly and returned to the fluidized-bed gasification furnace 1. Metals in the incombustibles f are recovered in an unoxidized and clean condition because the fluidized-bed 2 in the fluidized-bed gasification furnace 1 is kept at a relatively low temperature and in a reducing atmosphere. The sand e in the fluidized-bed 2 makes a revolving flow in such a manner that the sand descends in the central region and ascends in the peripheral region of the fluidized-bed. Therefore, the wastes q can be gasified highly efficiently. Solid carbon which has been generated by gasification is crushed by the revolving flow of the sand to be converted into fine particles that are conveyed by an upward gas flow. The sand e which is used as a bed material in the gasification furnace preferably comprises silica sand that is hard and readily available. The hard bed material makes it possible to pulverize the solid carbon with ease by its fluidization and revolving motion. In the case of silica sand, its average diameter is in the range of 0.4 to 0.8 mm.

The gas generated in the gasification furnace 1, which contains the solid carbon, is tangentically blown into an upper portion of the combustion chamber 6 in the swirling-type melting furnace 5 in an accelerated state so as to form a swirling flow, and is mixed with oxygen c supplied from several nozzles so as to form swirling flows and is instantaneously gasified at a high temperature ranging from 1200 to 1500° C. If necessary, the steam d may be added to the oxygen c. Therefore, ash content in the solid carbon is instantaneously converted into slag mists. Since the swirling-type melting furnace 5 having high load capacity is employed, the swirling-type melting furnace 5 becomes relatively compact and radiation heat loss can be reduced. The slag mists can be trapped efficiency because of centrifugal forces caused by the swirling flow. Inasmuch as the residence time of the gas in the combustion chamber 6 is free of fluctuations, the amount of residual carbon j is greatly reduced. The residence time of the gas in the combustion chamber 6 is in the range of from 2 to 10 second, preferably from 3 to 6 second. If carbon loss can be reduced, the load on a facility for retaining the residual carbon to the gasification furnace can be lowered.

Figure 2:
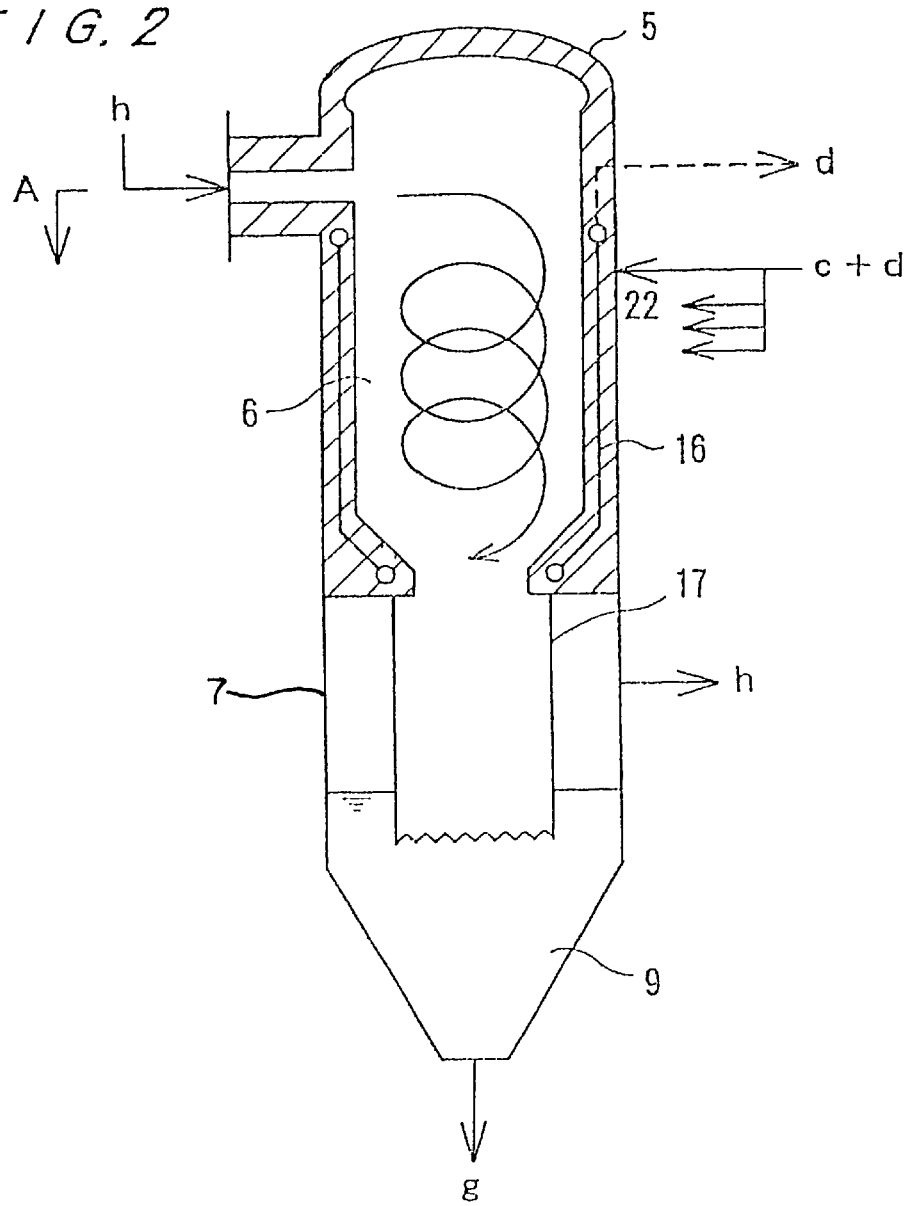
FIG. 2 is a cross-sectional view of another swirling-type melting furnace according to the present invention.
Figure 3:
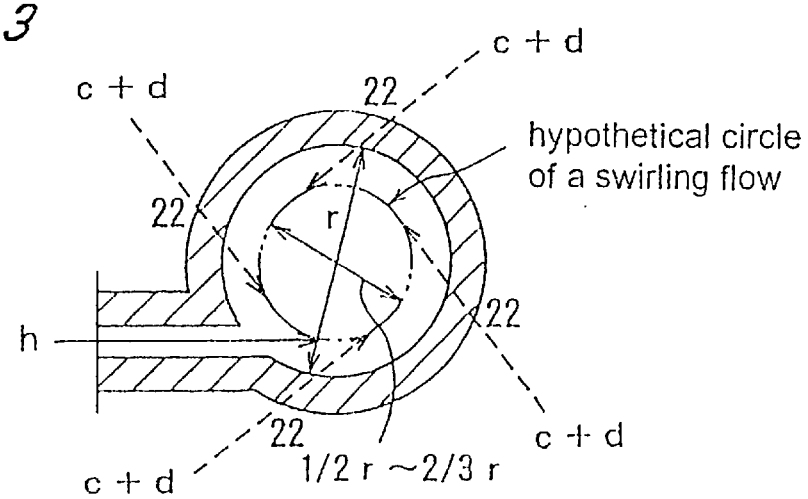
FIG. 3 is a horizontal cross-sectional view of the swirling-type melting furnace shown in FIG. 2.

FIG. 2 is a vertical cross-sectional view of the swirling-type melting furnace, and FIG. 3 is a horizontal cross-sectional view of the swirling-type melting furnace taken along line A of FIG. 2. In FIGS. 2 and 3, the generated gas h from the fluidized-bed gasification furnace 1, and the oxygen c and steamd supplied through a side wall of the swirling-type melting furnace 5 form a swirling flow having the same diameter as the diameter of a hypothetical circle when they are blown tangentially to a hypothetical cylinder.

The diameter of the hypothetical circle formed by the swirling flow is in the range of ½ to ⅓ of the inner diameter r of the swirling-type melting furnace 5. In the case where the inner diameter r of the swirling-type melting furnace 5 is larger than 1.5 m, it is preferable to allow the hypothetical circle to be spaced at about 250 mm from the furnace wall. In the case where the diameter of the hypothetical circle is larger than the diameter of the thus spaced hypothetical circle, the flames will directly contact the furnace wall to accelerate damage to the furnace wall. The generated gas h, and the oxygen c and steamd are blown downwardly from the horizon at an angle ranging from 3 to 15°, preferably from 5 to 10°. When the gas h is blown just horizontally, there is a possibility that a part of char contained therein will enter a dead space in the upper portion of the combustion chamber 6 and create a lump of slag. In the case where the generated gas h is blown at a downward angle, all of char contained therein can be conveyed by the swirling flow. However, if the downward angle at which the gas h is blown is too large, then gaps will be created between streams of the swirling flow, thus shortening the substantial residence time of the gas in the combustion chamber and lowering gasification efficiency. The oxygen c and steamd d should also preferably be blown at the same angle as the gas h to promote, rather than disturb, the swirling flow created by the gas h.

Figure 17:
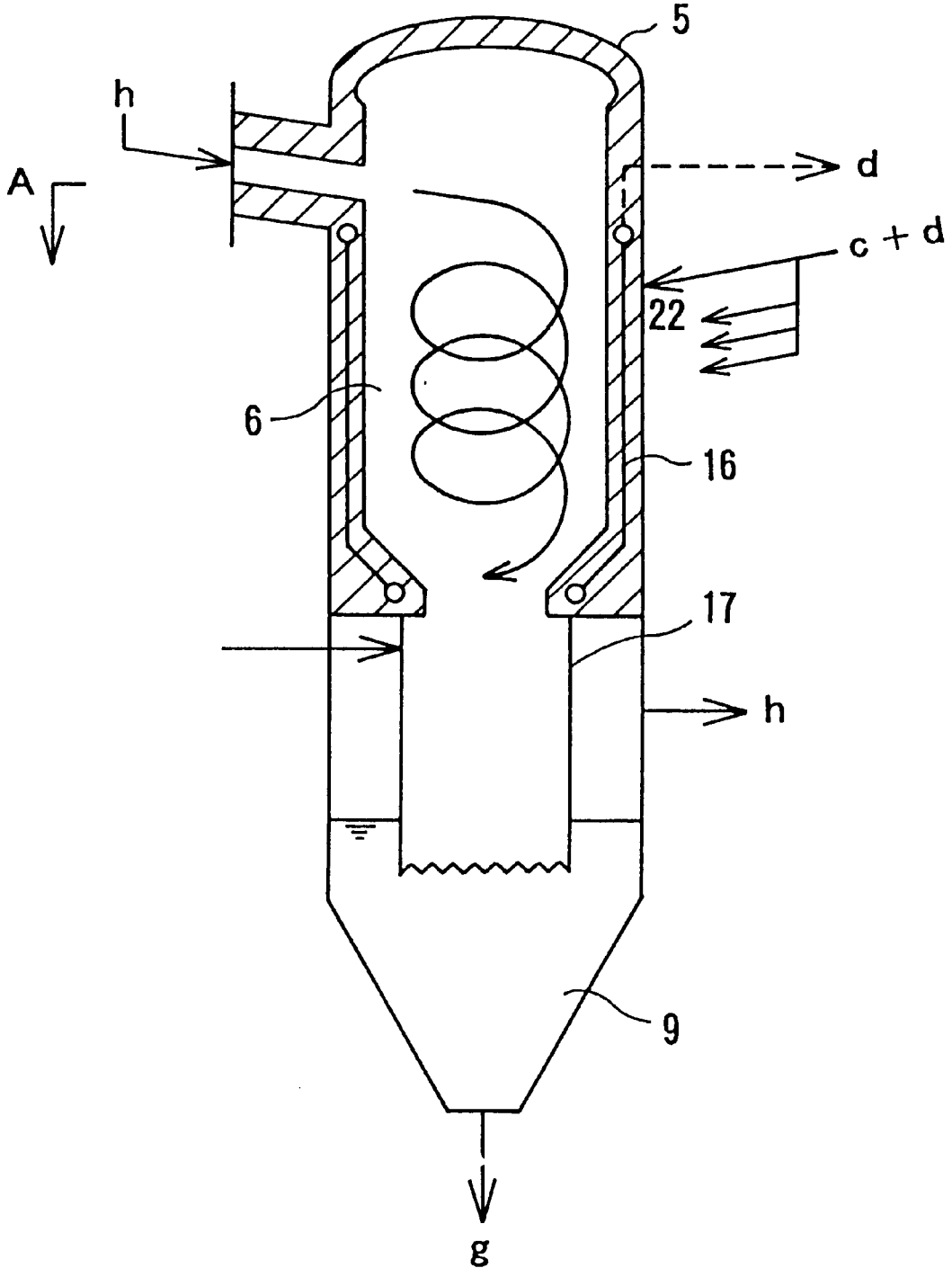
FIG. 17 is a cross-sectional view of another swirling-type melting furnace different from the swirling-type melting furnace shown in FIG. 2.

A method of blowing the gas h generated by gasification and the oxygen c into the combustion chamber is illustrated in FIG. 17. As shown in FIG. 17, the generated gas h, the oxygen c, and the steam d are blown into the combustion chamber at an angle inclined downwardly from the horizon.

The generated gas h from the fluidized-bed gasification furnace 1 flows at a speed ranging from 10 to 30 m/sec, and the oxygen c supplied through the side wall of the swirling-type melting furnace 5 flows at a speed ranging from 20 to 60 m/sec.

If the gaseous materials contain a large amount of combustible particles such as char, it is preferable to mix oxygen with steam. This is because the amount of steam supplied to the fluidized-bed gasification furnace is insufficient to the amount of steam required for converting carbon into carbon monoxide (CO) and hydrogen with a water gas reaction.

Swirling the gaseous materials in the combustion chamber in this way can bring the char and the oxygen c into direct contact with each other for thereby increasing the carbon conversion ratio and the cold gas efficiency. It is preferable to allow the swirling flow to be spaced from the furnace wall for thereby reducing damage to the furnace wall and lowering heat transmission from the refractory material to the boiler tubes.

For designing the structure of the joint between the outlet of the combustion chamber 6 and the slag separation chamber 7 in the swirling-type melting furnace 5 shown in FIG. 1 it is necessary to consider two requirements for weakening the swirling flow and preventing slag from being deposited on the radiation boiler 8. The gas flowing into the slag separation chamber 7 descends within the radiation boiler 8 while its swirling flow is being weakened. The gas whose temperature is lowered by absorption of radiation heat passes through a passage between the water level and the radiation boiler 8, and then ascends behind the radiation boiler 8. After a heat exchange with the radiation boiler 8, the gas h is discharged from the slag separation chamber 7. Slag flowing down from the combustion chamber 6 drops into water in the water tank 9 and is quenched. The slag granules g stored in the water tank 9 are discharged into the reservoir 11 through the lock hopper 10. Since the coarse slag granules $g_c$ collected in the reservoir 11 do not contain residual carbon, they will be utilized as various construction and building materials or a cement material. Most of the slag granules collected in the water tank 9 of the slag separation chamber 7 are the coarse slag granules $g_c$.

The gas which has been discharged from the swirling-type melting furnace 5 is supplied to the convection boiler 13 where the heat is recovered again, and then fully washed by the scrubber 14. If the wastes q contain vinyl chloride, then the gas generated therefrom contains highly concentrated HCl (hydrogen chloride). However, such HCl can be removed almost completely by scrubbing the gas with an aqueous solution of an alkali agent such as NaOH (sodium hydroxide) or $Na_2CO_3$ (sodium carbonate). A small amount of slag mists n and unreacted carbon j which have been conveyed by the gas from the slag separation chamber 7 are trapped by the scrubber 14. The fine slag particulates $g_f$ which are discharged to and settled and concentrated in the reservoir 15 should preferably be returned to the gasification furnace because they contain a considerable amount of residual carbon j. Although no flowchart for downstream of the scrubber 14 is illustrated, the gas from the scrubber 14 will be refined in accordance with a method depending on the purpose of utilizing the gas.

Table 1 shows water contents, ultimate analysis, and calorific values of a mixture (to be gasified) of coal, plastic wastes, shredder dust, and sewage sludge which have respective ratios of 40:30:20:10.

TABLE 1

Analysis of gasification materials

| | Coal | Plastic wastes | Shredder dust | Sewage Sludge | Mixture |
|---|---|---|---|---|---|
| Water % (wet) | 8.0 | 4.7 | 7.2 | 81.3 | 14.2 |
| C % (dry) | 66.8 | 54.0 | 49.0 | 35.7 | 58.0 |
| H % (dry) | 5.0 | 8.2 | 6.6 | 4.5 | 6.4 |
| O % (dry) | 7.3 | 27.6 | 22.9 | 23.8 | 17.8 |
| N % (dry) | 1.7 | 0.3 | 0.6 | 2.1 | 1.0 |
| S % (dry) | 4.2 | 0.07 | 0.19 | 0.5 | 1.88 |
| Cl % (dry) | — | 2.09 | 2.04 | — | 1.14 |
| Ash % (dry) | 15.0 | 7.74 | 18.7 | 33.4 | 13.8 |
| 1* | 6,910 | 6,040 | 5,405 | 3,535 | 6,222 |
| 2* | 6,357 | 5,756 | 5,016 | 661 | 5,339 |
| 3* | 40 | 30 | 20 | 10 | |

1*: Higher calorific value kcal/kg (dry base)
2*: Higher calorific value kcal/kg (wet base)
3*: Weight percent % (wet base)

TABLE 2

Material balance (for 1000 kg/h of mixture)

| | Inflow | | | Outflow | |
|---|---|---|---|---|---|
| | Mixture | Gas supplied to gasification furnace | Gas supplied to melting furnace | Incombustibles from gasification furnace | Gas from melting furnace |
| Water kg/hr | 141.8 | 547.3 | | | 689.1 |
| C kg/hr | 497.8 | | | | 497.8 |
| H kg/hr | 54.8 | | | | 54.8 |
| O kg/hr | 152.8 | 243.2 | 486.4 | | 882.4 |
| N kg/hr | 8.6 | | | | 8.6 |
| S kg/hr | 16.2 | | | | 16.2 |
| Cl kg/hr | 9.8 | | | | 9.8 |
| Ash kg/hr | 118.2 | | | 39.4 | 78.8 |
| Total | 1,000 | 790.5 | 486.4 | 39.4 | 2,237.5 |
| kg/hr | | 2,276.9 | | 2,276.9 | |

Table 2 shows an expected material balance.

It can be seen from Table 2 that for 1,000 kg/hr of mixture, 790.5 kg/hr of oxygen and steam needs to be supplied to the gasification furnace and 486.6 kg/hr of oxygen needs to be supplied to the melting furnace, and 2,237.5 kg/hr of gas is obtained from the melting furnace. As for the gas from the melting furnace, 78.8 kg/hr is ash content, with 80–90% of the ash content being coarse slag granules and 10–20% thereof being fine slag particulates.

Table 3 shows wet and dry compositions of the gas from the outlet of the combustion chamber of the melting furnace.

TABLE 3

Gas composition from melting furnace combustion chamber

| | Wet composition | Dry composition |
|---|---|---|
| Water Vol. % | 35.7 | |
| $H_2$ Vol. % | 24.2 | 37.7 |
| CO Vol. % | 26.0 | 40.4 |
| $CO_2$ Vol. % | 12.8 | 19.8 |
| $NH_3$, HCl, $H_2S$, etc. Vol. % | 1.3 | 2.1 |

It can be seen from Table 3 that nearly 80% of the dry gas composition is $H_2$ and CO as the combustible gas. Since the temperature of the melting furnace is high, almost no $CH_4$ (methane) is generated. The cold gas efficiency obtained from the gas composition shown in Table 3 was 68.9%. The total quantity of oxygen used as a gasifying agent was 45% of the quantity of oxygen required for complete combustion.

Figure 4:
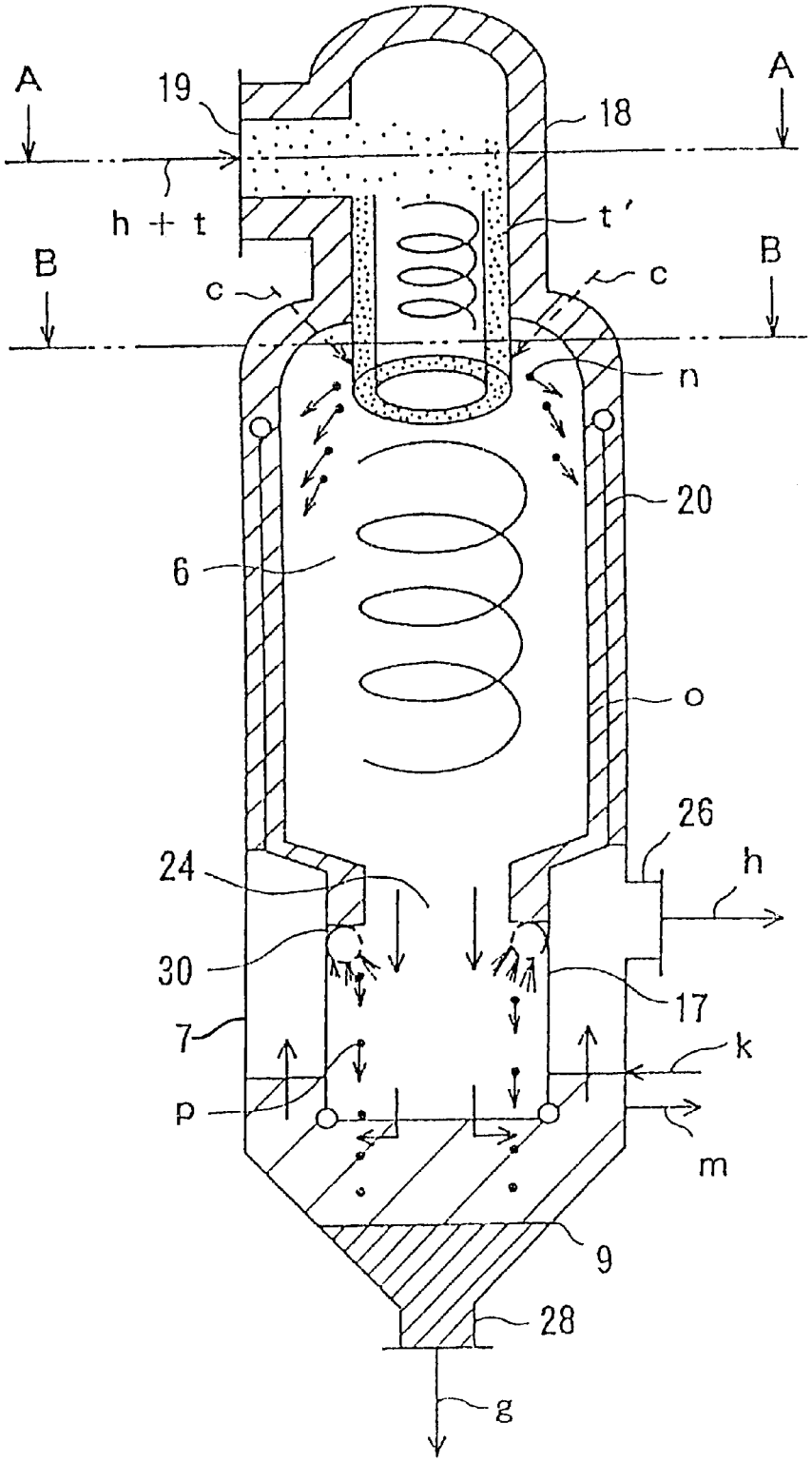
FIG. 4 is a cross-sectional view of a swirling-type melting furnace different from the swirling-type melting furnace shown in FIG. 2.

FIG. 4 shows a cross sectional view of a swirling-type melting furnace according to another embodiment of the present invention.

In this embodiment, combustible gas containing particulate solid is supplied to an introduction section provided immediately above a combustion chamber to create a swirling flow. Under centrifugal forces generated by the swirling flow, the particulate solid in the gas is concentrated in the vicinity of the wall surface, and supplied to a combustion chamber having a diameter larger than a diameter of the introduction section while the swirling flow is being maintained.

The introduction section immediately above the combustion chamber, to which the combustible gas containing the particulate solid is supplied, has a diameter which should be ¼ to ¾, or more preferably about ½, of the diameter of the combustion chamber. Oxygen-containing gas should be blown into the combustion chamber from two or more nozzles on an upper side wall of the combustion chamber, and in tangential direction to a hypothetical cylinder that is an extension from the inner wall of the introduction section. In this embodiment, since the port from which the generated gas is blown and the nozzles from which oxygen is blown are vertically spaced from each other, it is less likely for a lump of slag to be formed in a dead space in the upper portion of the combustion chamber than with the embodiment shown in FIG. 2. The oxygen-containing gas is preferably blown at an angle ranging from 10 to 70° downwardly from the horizon. By blowing the oxygen-containing gas at the downward angle, the flames can be extended downwardly to prevent the furnace wall from being damaged by direct exposure to the flames.

The temperature in the combustion chamber is set so as to be 50 to 100° C. higher than the ash fusion temperature, and to be in the range of 1200 to 1600° C. Since an increase in the temperature in the combustion chamber accelerates damage to the furnace wall, limestone may be added, if necessary, to lower the ash fusion temperature.

Figure 5:
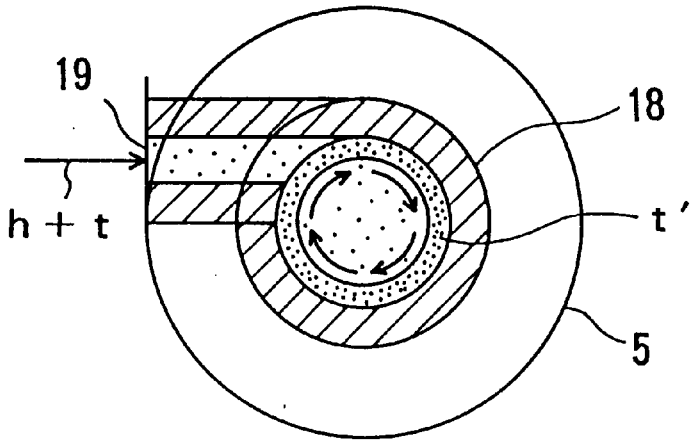
FIGS. 5(*a*) and 5(*b*) are horizontal cross-sectional views of the swirling-type melting furnace shown in FIG. 4, respectively.
Figure 5:
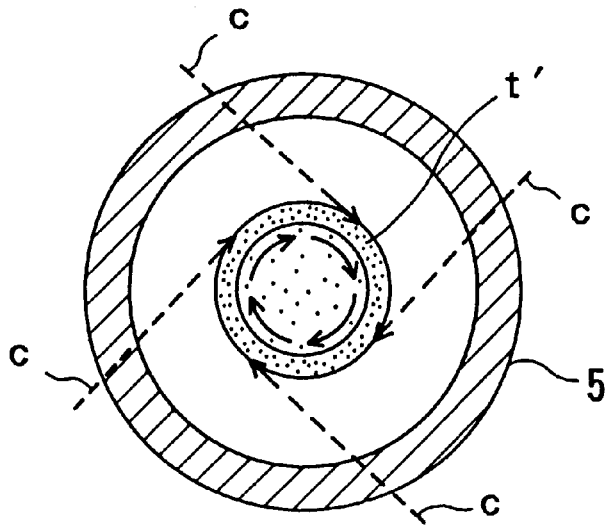

In FIG. 4, the swirling-type melting furnace has an introduction section 18 having a gaseous material inlet 19, and oiler water tubes 20. The symbol h, t, and t' represent gaseous materials, char, and a concentrated char layer, respectively. The gas h and the char t which have been generated in a low-temperature gasification furnace (not shown) at a preceding stage are supplied to the gaseous material inlet 19 of the introduction section 18 of the swirling-type melting furnace 5, and create a strong swirling flow in the introduction section 18. Under centrifugal forces created by the swirling flow, the char t in the gas is concentrated in the vicinity of the wall surface, thus forming the cylindrical char concentrated layer t'. FIG. 5(*a*) is a cross-sectional view taken along line A—A of FIG. 4 and showing the introduction section. As shown in FIG. 5(*a*), the concentrated layer t' of the char t is formed along the wall surface of the introduction section 18.

Referring back to FIG. 3, when the gas is introduced into the combustion chamber 6 in a swirling state, the oxygen c and the steam d are blown from four nozzles 22 disposed at equal intervals in the upper portion of the combustion chamber to conduct gasification at a high temperature of about 1400° C., thereby generating gas mainly composed of hydrogen, carbon monoxide, carbon dioxide, and steam. In FIG. 3, the four oxygen blowing nozzles are disposed at equal intervals in the upper portion of the combustion chamber. However, the number of oxygen blowing nozzles is not limited to the illustrated number, but may be increased or decreased, if necessary, depending on the size of the swirling-type melting furnace 5. In FIG. 4, the ash content in the char t trapped by the wall surface of the gas introduction section 18 may be partly melted by the radiation heat from the combustion chamber 6, and there form clinker. In order to solve this problem, it is effective to supply a part of the oxygen c and the steam d into the introduction section 18 to increase the temperature in the introduction section 18.

Since the char t is burned at a high temperature, the ash content in the char t becomes slag mists n. FIG. 5(*b*) is a cross-sectional view taken along line B—B of FIG. 4 and showing an upper portion of the combustion chamber. As shown in FIG. 5(*b*), the oxygen c is blown downwardly from portions around the combustion chamber 6 to directly strike the cylindrical char concentrated layer t' produced in the introduction section 18, thereby oxidizing and decomposing the char t preferentially to thus be a heat source for gasification. In this way, the highly efficient gasification with reduced production of the residual carbon can be accomplished.

Most of the slag mists n is deposited on the wall surface by the swirling flow, thus forming a thin slag layer o. The gas and the slag mists n remaining in the gas pass through the throat 24 and enter the slag separation chamber 7. Similarly, the slag flowing down the slag layer o on the wall surface of the combustion chamber drops as slag droplets p into the slag separation chamber 7. The gas and the slag passing through a guide tube 17 are cooled by water from auxiliary spray nozzles 30 disposed circumferentially at a joint corner of the guide tube 17 beneath the throat 24 while at the same time the inner wall surface of the guide tube 17 is being cooled. Thereafter, the gas and the slag are blown into the water in the water tank 9 and quenched. The gas ascending along the outside of the guide tube 17 is discharged from a gas outlet 26 in the slag separation chamber 7. In this embodiment, since the guide tube 17 is of a boiler structure, it is not necessary to cool the guide tube 17. The slag g deposited on the bottom of the water tank 9 is discharged from a slag outlet 28. The residual carbon is recycled as a gasification material, and should preferably be small in quantity.

Figure 6:
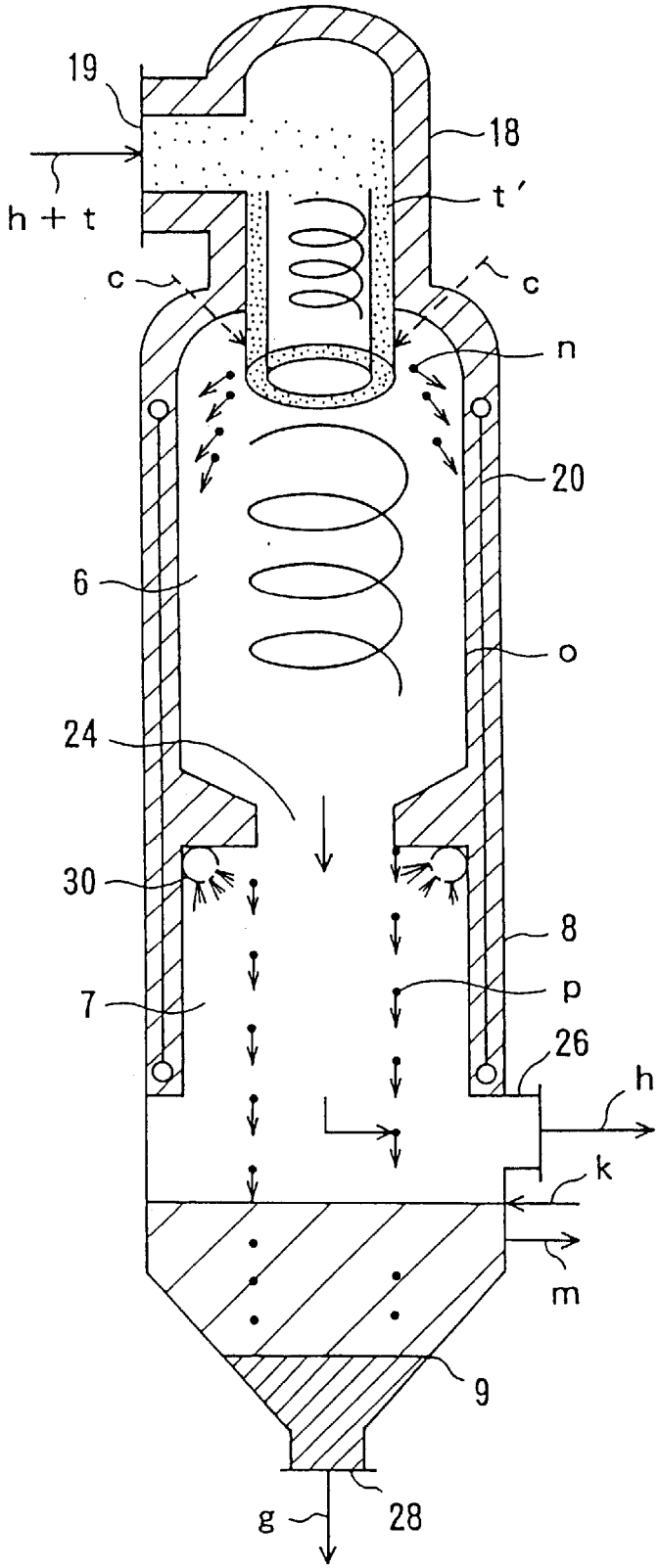
FIG. 6 is a cross-sectional view of another swirling-type melting furnace different from the swirling-type melting furnace shown in FIG. 2.

FIG. 6 shows another swirling-type melting furnace according to the present invention. The swirling-type melting furnace has a radiation boiler 8 in a slag separation chamber 7 and also has a water tank 9 at the bottom of the slag separation chamber 7. The gas and the slag generated in the combustion chamber 6 enter into the slag separation chamber 7 through the throat 24. The radiation boiler 8 in the slag separation chamber 7 efficiently absorbs the radiation heat of the gas and the slag. The gas that has passed through the radiation boiler 8 is turned over immediately above the water level, and the slag droplets are caused to fall into the water due to inertia force. Thereafter, the gas is discharged from a gas outlet 26 in a side wall of the slag separation chamber 7. Because the gas is supplied to a convection boiler (not shown) at a subsequent stage without direct contact with the water, a large amount of steam having a high temperature and a high pressure can be recovered. The high-temperature oxidizing furnace of this type is used for the purpose of power generation.

Figure 7:
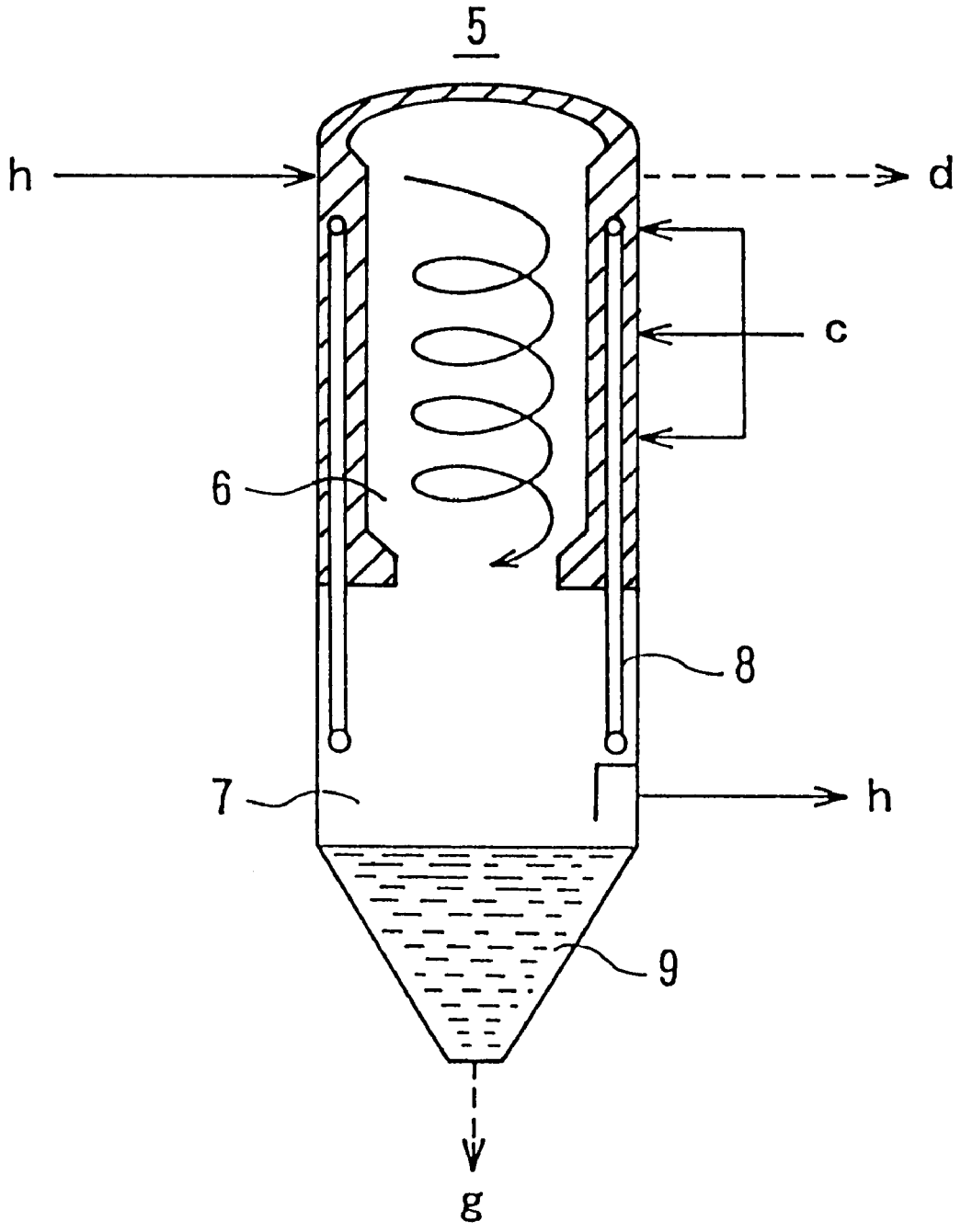
FIG. 7 is a cross-sectional view of another swirling-type melting furnace different from the swirling-type melting furnace shown in FIG. 1.
Figure 15:
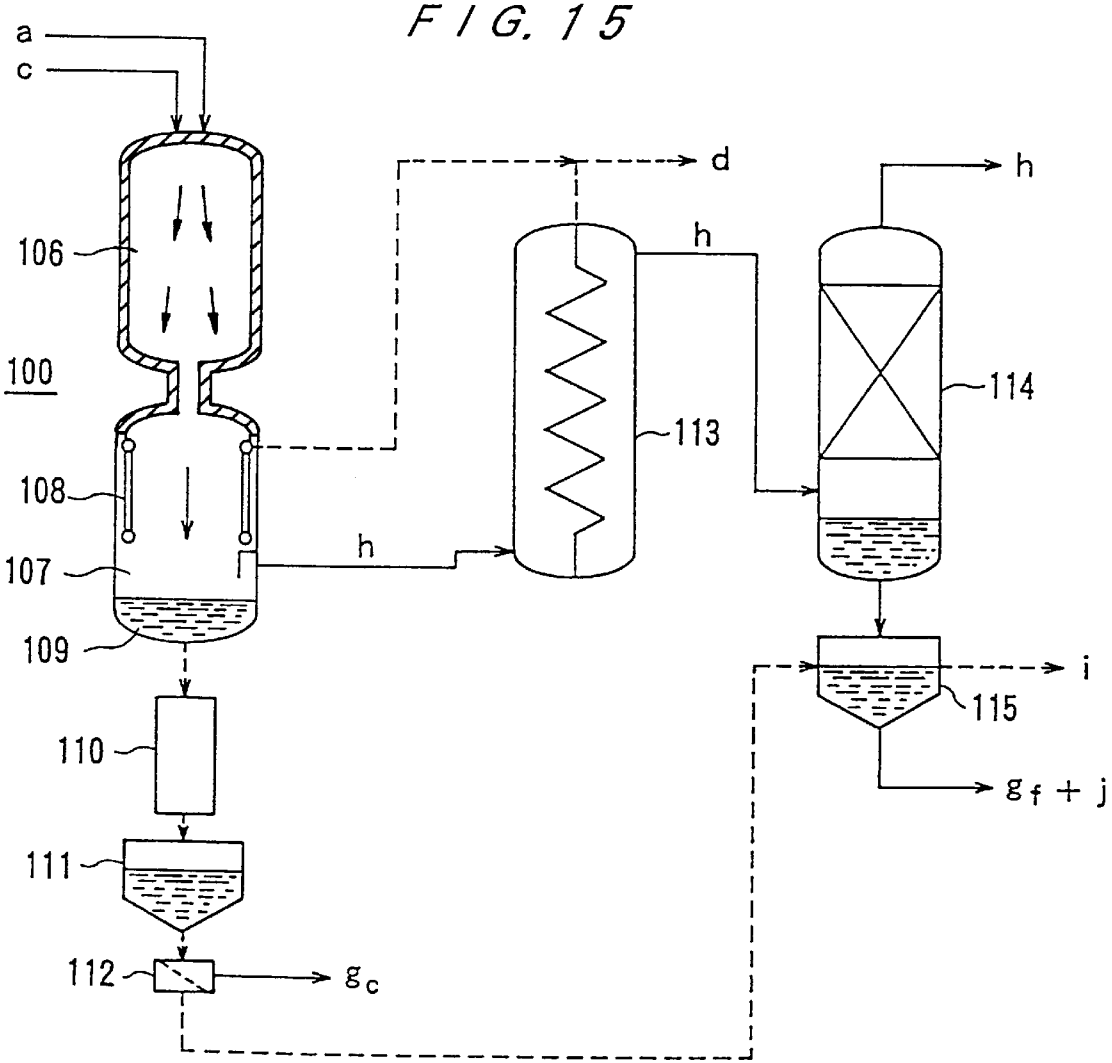
FIG. 15 is a cross-sectional view of a Texaco-type waste-heat-boiler-type gasification furnace.
Figure 16:
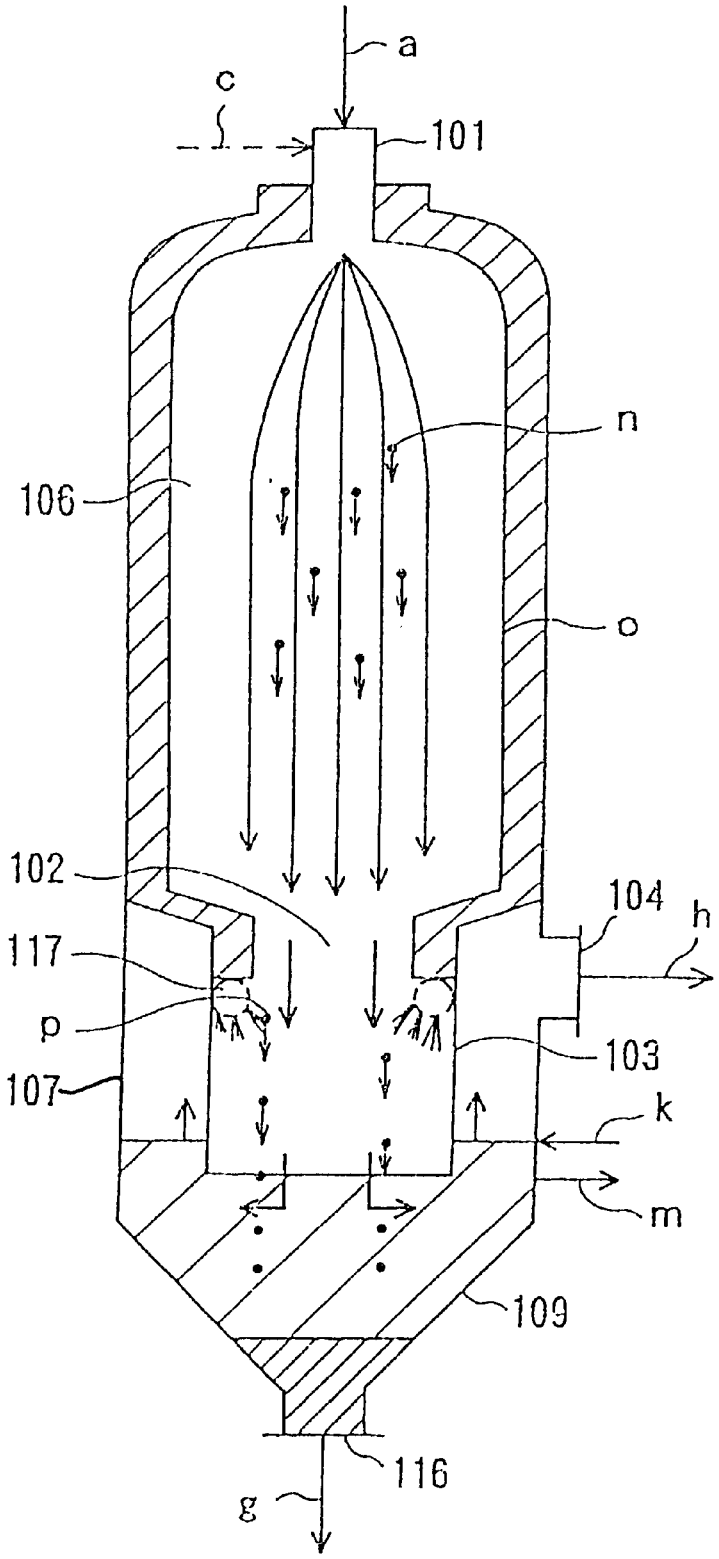
FIG. 16 is a cross-sectional view of a Texaco direct-quench-type gasification furnace.

FIG. 7 shows another swirling-type melting furnace 5 having a radiation boiler 8 on a wall surface of a slag separation chamber 7. The slag separation chamber 7 is of a structure which is substantially the same as the slag separation chamber shown in FIG. 15. Gas flowing down the inside of the radiation boiler 8 is discharged from a gas outlet provided on a side wall between the lower end of the radiation boiler 8 and the water level. A cover for preventing slag from entering into the gas outlet is provided in front of the gas outlet. Inasmuch as the radiation boiler 8 is installed apart from the area where the slag drops, the swirling-type melting furnace 5 shown in FIG. 7 is advantageous in that the slag is less liable to be attached to the radiation boiler 8. However, the swirling-type melting furnace 5 shown in FIG. 7 is disadvantageous in that only the inner surface of the radiation boiler 8 is utilized for heat recovery.

Figure 8:
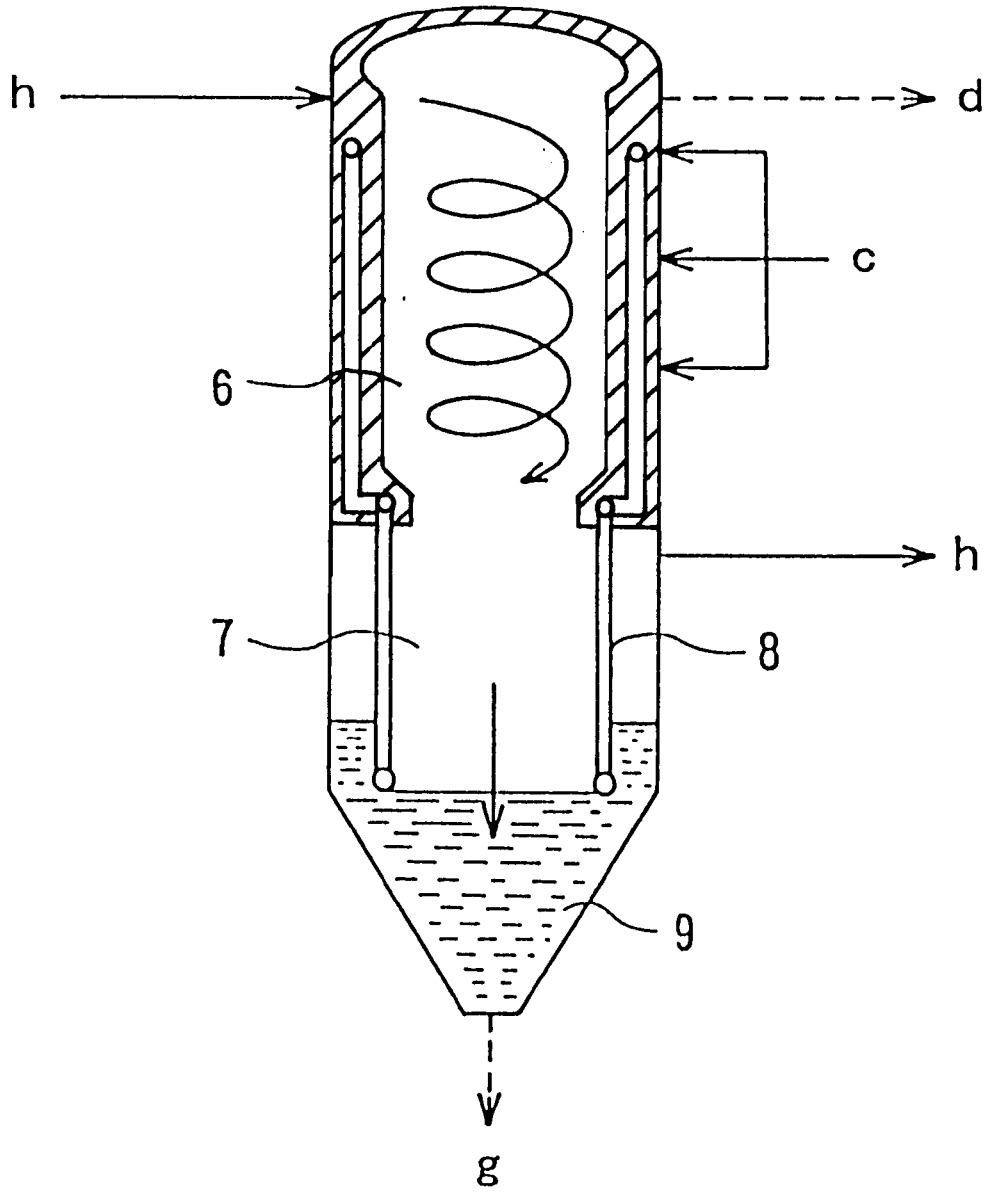
FIG. 8 is a cross-sectional view of another swirling-type melting furnace different from the swirling-type melting furnace shown in FIG. 2.

FIG. 8 shows still another swirling-type melting furnace 5 which has a radiation boiler 8 whose lower end is extended so as to be submerged in water for thereby blowing the gas into the water. This structure serves to lower the temperature of the gas whose heat has been recovered by the radiation boiler 8, to a temperature of 250° C. or below all at once, and also to trap most of slag mists n and residual. Since the amount of evaporated water is increased, the swirling-type melting furnace 5 shown in FIG. 8 is suitable for applications where the steam can effectively be used in a subsequent process. One example is an application where all the amount of CO in the generated gas is converted into $H_2$ by a CO shift reaction. However, the coarse slag granules, the fine slag particulates, and the residual carbon; are mixed together, they will subsequently be required to be classified by a screen or the like. Further, because most of metals having low boiling points contained in the wastes are trapped in the water, it should be taken into consideration that the load on the wastewater treatment is increased.

Figure 9:
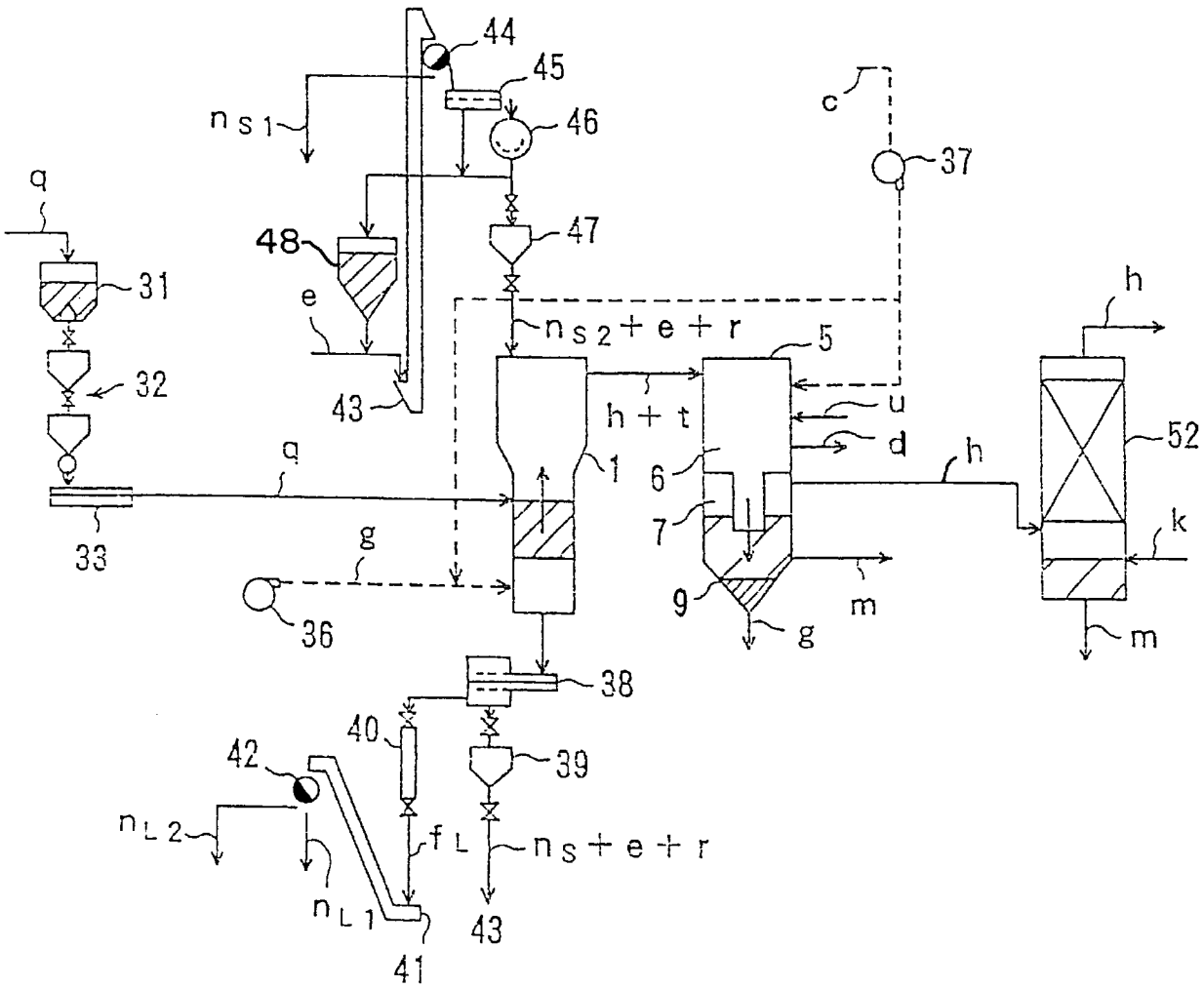
FIG. 9 is a schematic diagram of another gasification system which incorporates a swirling-type melting furnace according to the present invention.

FIG. 9 shows main reactors in a two-stage gasification system for producing a mixture of hydrogen ($H_2$) and carbon monoxide (CO) from wastes. The two-stage gasification system comprises a material reservoir 31, a material lock hopper 32, a material supply device 33, a fluidized-bed gasification furnace 1, a swirling-type melting furnace 5, an air compressor 36, an oxygen compressor 37, an incombustible dischargeer 38, a bed material lock hopper 39, an incombustible lock hopper 40, an incombustible conveyor 41, a magnetic separator 42, a bed material circulating elevator 43, a magnetic separator 44, a vibrating screen 45, a pulverizer 46, a bed material lock hopper 47, a bed material hopper 48, and a gas scrubber 52. The symbols q, g, f, and e represent wastes, air, incombustibles (a suffix L represents incombustibles on the screen of the incombustible discharger 38, a suffix S represents incombustibles under the screen of the incombustible discharger 38, a suffix 1*a* represents magnetic incombustibles, and a suffix 1*b* represents nonmagnetic incombustibles), sand, respectively. The symbols r, u, and d represent carbonous materials water, and steam, respectively.

The wastes q which have been crushed and classified in a preparation treatment are stored in the material reservoir 31, and then pass through the material lock hopper 32 in which inner pressure is increased to about 40 atm. Thereafter, the wastes q are supplied at a constant rate to the fluidized-bed gasification furnace 1 by the material supply device 33 which is a screw type. A mixture of air g and oxygen ($O_2$) c is delivered as a gasifying agent and at the same time a fluidizing gas into the fluidized-bed gasification furnace 1 from its lower portion. The wastes are charged into a fluidized-bed of sand e in the fluidized-bed gasification furnace 1, and contacted with the oxygen in the fluidized-bed which is kept at a temperature ranging from 550 to 850° C., and hence the wastes are quickly pyrolized and gasified. The sand is intermittently discharged together with the incombustibles f and the carbonous materials r from the bottom of the fluidized-bed gasification furnace 1. Large incombustibles $f_L$ are separated by the incombustible discharger 38, and depressurized by the incombustible lock hopper 40. Thereafter, the large incombustibles $f_L$ are elevated by the incombustible conveyor 41 to the magnetic separator 42 in which they are classified into magnetic incombustibles $n_{L1}$ such as iron, and nonmagnetic incombustibles $n_{L2}$. The sand under the screen of the incombustible discharger 38 is delivered together with incombustibles $f_S$ and carbonous materials r upwardly by the bed material circulating elevator 43 to the magnetic separator 44 in which magnetic incombustibles $n_{S1}$ are separated. Subsequently, by the vibrating screen 45 and the pulverizer 46 of the ball mill type, the incombustibles f and the char r are pulverized, but the sand e of the bed material is not pulverized. The incombustibles f and the carbonous materials r which have been pulverized are returned to the gasification furnace 1. Metals in the incombustibles are recovered in an unoxidized and clean state because the inside of the gasification furnace is in a reducing atmosphere.

Gas, tar, and carbonous materials are generated when the charged wastes are pyrolized and gasified. The carbonous materials are pulverized into char by the stirring action of the fluidized-bed. Since the chart which is solid material is porous and light, it is carried by the flow of gaseous materials comprising gas and tar. The gaseous materials h which have been discharged from the gasification furnace 1 are supplied to the swirling-type melting furnace 5 and introduced into the combustion chamber 6. In the combustion chamber 6, the gaseous materials h are mixed with the blown oxygen c in a swirling flow, and oxidized and decomposed at a high temperature of 1400° C. Generated gas, which is mainly composed of hydrogen, carbon monoxide, carbon dioxide and steam, is scrubbed and quenched, together with the slag g, by direct contact with water in the slag separation chamber 7. The gas h that has been discharged from the slag separation chamber 7 is supplied to the gas scrubber 52 in which remaining dust, hydrogen chloride and the like are removed therefrom. Slag granules g deposited in the water tank 9 are discharged from a lower portion of the slag separation chamber 7. Wastewater m discharged through a side wall of the slag separation chamber 7 is treated by a wastewater treatment device (not shown) in the next process. The recovered slag will be utilized mainly as a cement material or construction and building materials.

Figure 10:
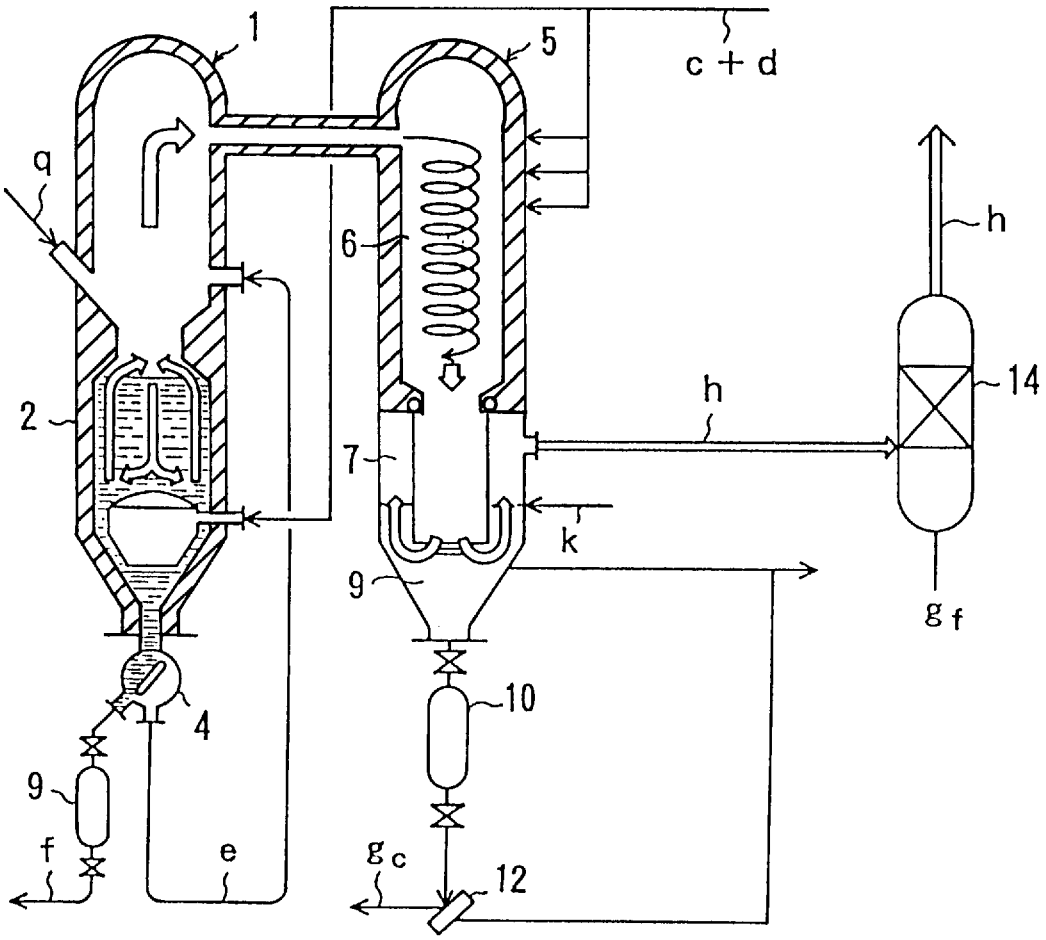
FIG. 10 is a schematic diagram of still another gasification system which incorporates a swirling-type melting furnace shown in FIG. 2.

FIG. 10 shows a gasification system 1 in another example. As the fluidized-bed gasification furnace 1, a fluidized-bed furnace in which a bed material e is circulated between central and peripheral regions of a fluidized-bed 2 is used. As the melting furnace 5, a swirling-type melting furnace in which combustible gas and a gasifying agent are swirled at a high speed and combusted at a high temperature is used.

Wastes q supplied to the gasification furnace 1 are gasified by being contacted with oxygen and steam in the fluidized-bed 2 which is preferably kept at a temperature ranging from 550 to 850° C. Incombustibles f are removed together with the bed material e, and separated from the bed material e by a screen 4. Only the incombustibles f are discharged through a lock hopper 10 to the outside of the furnace, and the bed material e is returned to the gasification furnace 1. Gas, tar and char generated by gasification are supplied to a combustion chamber 6 in the melting furnace 5 at a subsequent stage, and gasified at a high temperature ranging from 1200 to 1500° C. Ash content in the char is melted and converted into slag, and recovered as glass-like granules g from a water tank 9 in a slag separation chamber 7. A lock hopper 10 and a slag screen 12 are connected to the water tank 9. The generated gas h discharged from the melting furnace is supplied to a scrubber 14 in which slag mists and HCl are removed therefrom. After the gas h has been subjected to a CO shift reaction and an acid gas removing processes, it is converted into synthesis gas ($CO+H_2$). Since the purpose of this system is to convert wastes into synthesis gas, the gasification furnace and the melting furnace are supplied with oxygen c and steam d as a gasifying agent. The gasification furnace and the melting furnace are normally operated under a pressurized condition ranging from 10 to 40 atm.

In the fluidized-bed gasification furnace, sand (silica sand, Olivine sand, etc.), alumina, iron powder, limestone, dolomite, or the like is used as abed material. Among the wastes, biomass wastes, plastic wastes, automobile wastes, or the like are roughly crushed to a size of about 30 cm. The refuse-derived fuel and the solid water mixture are used as they are. The low-grade coal is roughly crushed to a size of 40 mm or smaller. These wastes are classified and charged into a plurality of pits, and well stirred and mixed in the respective pits. Thereafter, the wastes are supplied to the gasification furnace.

Figure 11:
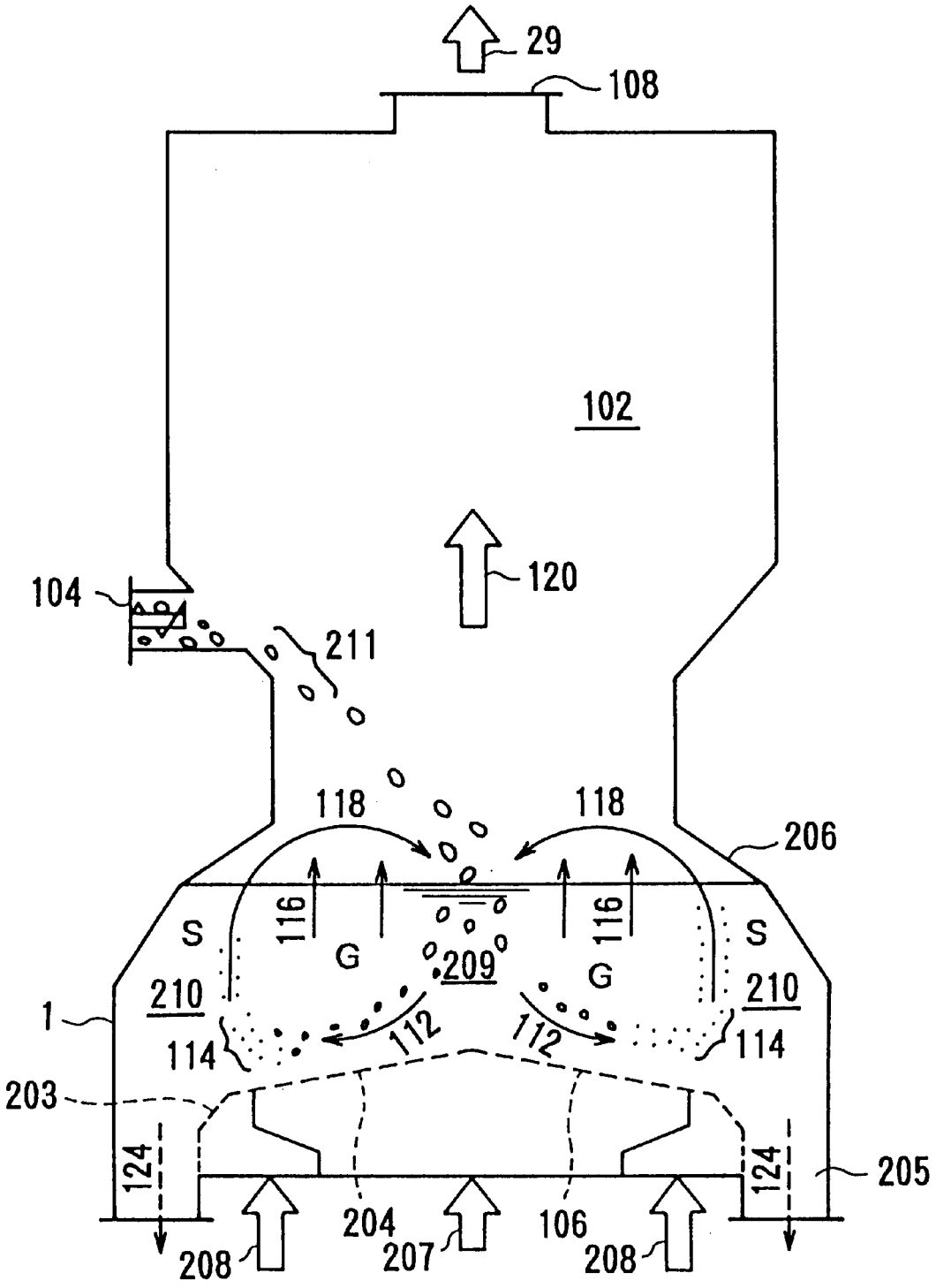
FIG. 11 is a cross-sectional view of an internal revolving-type fluidized-bed furnace used for a low-temperature gasification.
Figure 12:
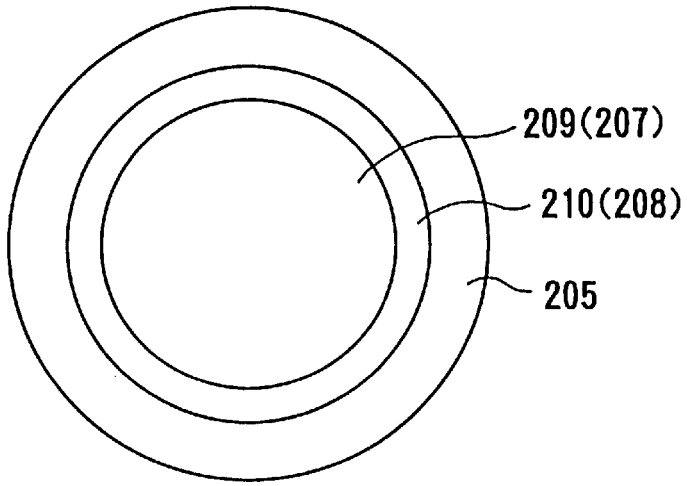
FIG. 12 is a horizontal cross-sectional view of a fluidized-bed in the internal revolving-type fluidized-bed furnace shown in FIG. 11.

FIG. 11 is a vertical cross-sectional view of a low-temperature gasification furnace, and FIG. 12 is a horizontal cross-sectional view of the gasification furnace shown in FIG. 11. In the gasification furnace shown in FIG. 11, fluidizing gases supplied to a fluidized-bed furnace 1 through a fluidizing gas dispersing mechanism disposed in the bottom thereof include a central fluidizing gas 207 supplied as an upward flow into the furnace from a central furnace bottom region 204 and a peripheral fluidizing gas 208 supplied as an upward flow into the furnace from a peripheral furnace bottom region 203.

Each of the central fluidizing gas 207 and the peripheral fluidizing gas 208 is selected from one of three gases, i.e., oxygen, a mixture of oxygen and steam, and steam. The oxygen content of the central fluidizing gas is lower than the oxygen content of the peripheral fluidizing gas 208. The total amount of oxygen in all of the fluidizing gases is set to be equal to or lower than 30% of the theoretical amount of oxygen required for combustion of wastes 211.

The mass velocity of the central fluidizing gas 207 is set to be smaller than the mass velocity of the peripheral fluidizing gas 208. The upward flow of the fluidizing gas in an upper peripheral region of the furnace is deflected toward a central region of the furnace by a deflector 206. Thus, a descending fluidized-bed 209 of the bed material (composed generally of silica sand) is formed in the central region of the furnace, and an ascending fluidized-bed 210 is formed in the peripheral region of the furnace. As indicated by the arrows 118, the bed material ascends in the ascending fluidized-bed 210 in the peripheral region of the furnace, is deflected by the deflector 206 into an upper portion of the descending fluidized-bed 209, and descends in the descending fluidized-bed 209. Then, as indicated by the arrows 112, the bed material moves along the fluidizing gas dispersing mechanism 106 and flows into a lower portion of the ascending fluidized-bed 210. In this manner, the bed material circulates in the ascending fluidized-bed 210 and the descending fluidized-bed 209 as indicated by the arrows 118, 112. In the case that the fluidized-bed has a small diameter, then the deflector 206 may be dispensed with because the flow of sand is turned over without the deflector 206.

While the wastes 211 supplied from a combustible inlet 104 to the upper portion of the descending fluidized-bed 209 descend together with the bed material in the descending fluidized-bed 209, the wastes 211 are gasified by the heat of the bed material. Because there is no or little oxygen available in the descending fluidized-bed 209, a high calorific gas generated by gasification is not combusted and passes through the descending fluidized-bed 209 as indicated by the arrows 116. Consequently, the descending fluidized-bed 209 forms a gasification zone G. The generated gas moves into a freeboard 102 as indicated by the arrow 120.

Char which has not been gasified in the descending fluidized-bed 209 moves together with the bed material from a lower portion of the descending fluidized-bed 209 to the lower portion of the ascending fluidized-bed 210 in the peripheral region of the furnace as indicated by the arrows 112, and is combusted by the peripheral fluidizing gas 208 having a relatively large oxygen content. The ascending fluidized-bed 210 forms an oxidation zone S for combustibles. In the ascending fluidized-bed 210, the bed material is heated by the heat produced when the char is combusted. The heated bed material is turned over by the inclined wall 206 as indicated by the arrows 118, and transferred to the descending fluidized-bed 209 where it serves as a heat source for gasification. In this manner, the fluidized-bed is kept at a temperature ranging from 550 to 850° C.

In the gasification furnace shown in FIGS. 11 and 12, the gasification zone G and the oxidation zone S are formed in the fluidized-bed 2, and the bed material becomes a heat medium in both zones. Therefore, combustible gas having a high calorific value is generated in the gasification zone G, and char is efficiently combusted in the oxidation zone S. Consequently, the fluidized-bed furnace 1 can gasify wastes efficiently.

In the horizontal cross sectional view of the fluidized-bed 2 shown in FIG. 12, the descending fluidized-bed 209 which forms the gasification zone G is circular in shape in the central region of the furnace, and the ascending fluidized-bed 210 which forms the oxidation zone S is annular around the descending fluidized-bed 209. The ascending fluidized-bed 210 is surrounded by a ring-shaped incombustible outlet 205. If the gasification furnace 1 is of a cylindrical shape, then it can easily keep a high pressure therein. Alternatively, the gasification furnace itself may not be of a pressure-durable structure, but may be protected by a pressure vessel (not shown) disposed around the gasification furnace.

Figure 13:
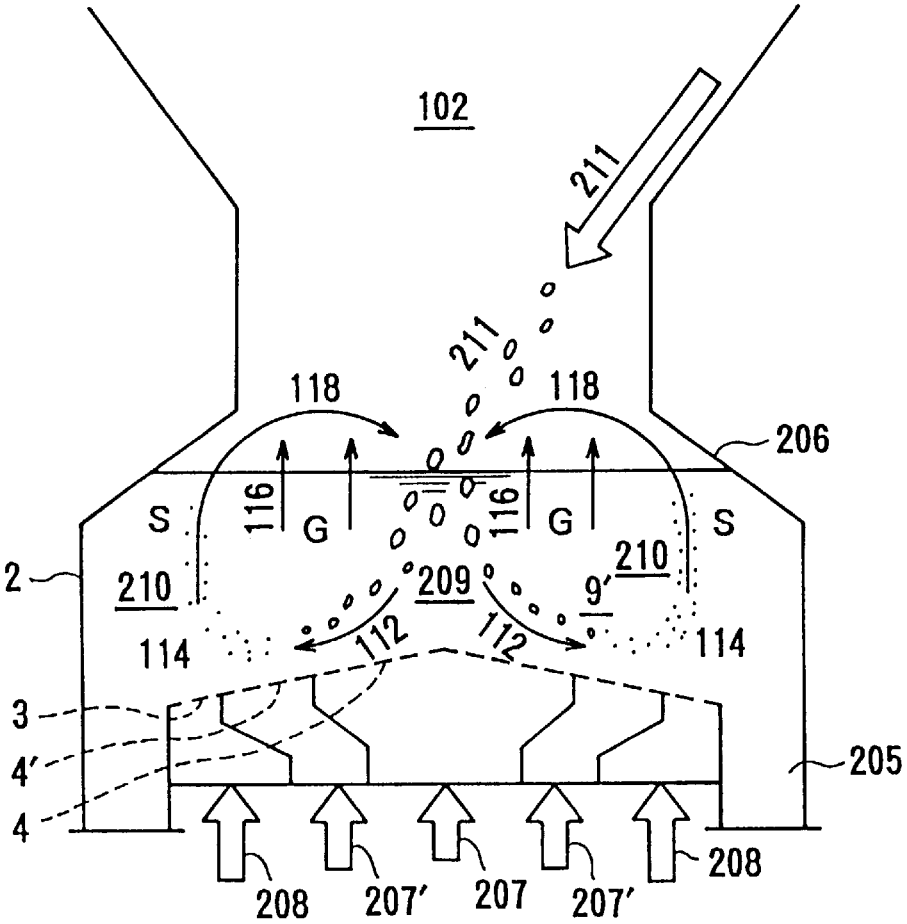
FIG. 13 is a cross-sectional view of another internal revolving-type fluidized-bed furnace different from the internal revolving-type fluidized-bed furnace shown in FIG. 11.
Figure 14:
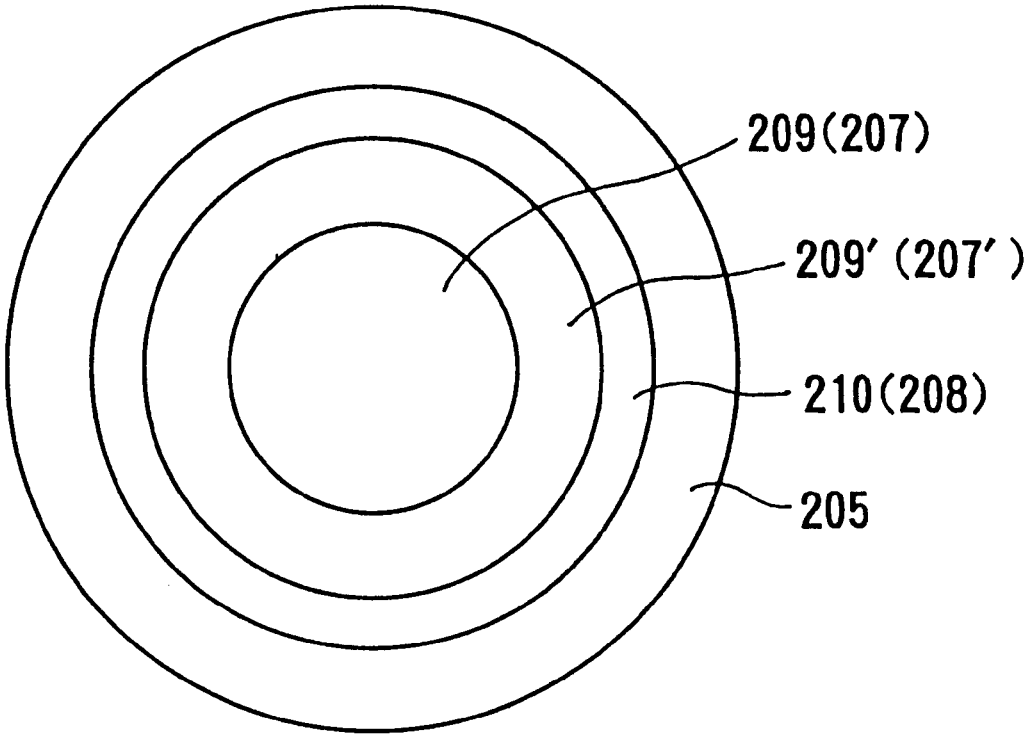
FIG. 14 is a horizontal cross-sectional view of a fluidized-bed in the internal revolving-type fluidized-bed furnace shown in FIG. 13.

FIG. 13 is a vertical cross-sectional view of another low-temperature gasification furnace, and FIG. 14 is a horizontal cross-sectional view of the gasification furnace shown in FIG. 13. In the gasification furnace shown in FIG. 13, fluidizing gases comprise a central fluidizing gas 207, a peripheral fluidizing gas 208, and an intermediate fluidizing gas 207' supplied to the furnace from an intermediate furnace bottom region between the central and peripheral furnace bottom regions. The mass velocity of the intermediate fluidizing gas 207' is set to a value selected between the mass velocity of the central fluidizing gas 207 and the mass velocity of the peripheral fluidizing gas 208. The central fluidizing gas is selected from one of three gases, i.e., steam, a mixture of steam and oxygen, and oxygen.

In the gasification furnace shown in FIG. 13, as is similar to the gasification furnace shown in FIG. 11, each of the central fluidizing gas 207 and the peripheral fluidizing gas 208 is selected from one of three gases, i.e., oxygen, a mixture of oxygen and steam, and steam. The oxygen concentration of the intermediate fluidizing gas is set to a value selected between the oxygen concentration of the central fluidizing gas and the oxygen concentration of the peripheral fluidizing gas. From the central region to the peripheral region of the fluidized-bed furnace, the oxygen concentration of the gases increases. The total amount of oxygen in all of the fluidizing gases is set to be equal to or lower than 30% of the theoretical amount of oxygen required for combustion of combustibles. The inside of the furnace is in a reducing atmosphere.

In the gasification furnace shown in FIG. 14, as is similar to the gasification furnace shown in FIG. 11, a descending fluidized-bed 209 in which a bed material descends is formed in the central region of the furnace, and an ascending fluidized-bed 210 in which the bed material ascends is formed in the peripheral region of the furnace. The bed material circulates in the descending fluidized-bed and the ascending fluidized-bed as indicated by the arrows 112, 118. Between the descending fluidized-bed 209 and the ascending fluidized-bed 210, an intermediate fluidized-bed 209' in which the bed material moves mainly laterally is formed. The descending fluidized-bed 209 and the intermediate fluidized-bed 209' form a gasification zone G, and the ascending fluidized-bed 210 forms an oxidization zone S.

In FIG. 13, combustibles 211 supplied into an upper portion of the descending fluidized-bed 209 are heated and gasified while the combustibles 211 descend together with the bed material in the descending fluidized-bed 209. Char that has been generated by the gasification in the descending fluidized-bed 209 moves together with the bed material into the intermediate fluidized-bed 209' and the ascending fluidized-bed 210, then is partially combusted. The bed material is heated in the ascending fluidized-bed 210, and moves into the descending fluidized-bed 209, thus gasifies combustibles in the descending fluidized-bed 209. Depending on whether the gasified materials contain a large amount or a small amount of volatiles, the oxygen concentration of the intermediate fluidizing gas 207' may be either reduced for thereby performing gasification mainly or increased for thereby performing combustion mainly.

In the horizontal cross sectional view of the fluidized-bed furnace shown in FIG. 14, the descending fluidized-bed 209 which forms the gasification zone is circular in shape in the central region of the furnace, and the intermediate zone 209' formed by the intermediate fluidizing gas 207' is disposed around the descending fluidized-bed 209. The ascending fluidized-bed 210 which forms the oxidization zone S is annular around the intermediate zone 209'. The ascending fluidized-bed 210 is surrounded by a ring-shaped incombustible outlet 205.

In the above embodiments, the swirling-type melting furnace is used as a high-temperature gasification furnace. However, the swirling-type melting furnace may also be used as a high-temperature combustion furnace. In the cases where the low calorific value of wastes is smaller than 3500 kcal/kg, the swirling-type melting furnace should preferably be used as a combustion furnace for the purpose of recovering steam having high temperature and a high pressure. The cases that the wastes are primary combustible materials and the coal is an auxiliary combustible material are shown in the embodiments, but the swirling melting furnace may be used to treat a combustible material which comprises 100% of coal, i.e., coal only.

According to the present invention having the above specified arrangements, the following advantages can be obtained:

(1) The combustion chamber in the melting furnace is of the swirling-type to thus perform a high load capacity.

(2) The combustion chamber is of a boiler structure for thereby protecting the furnace refractory and recovering an increased amount of steam.

(3) A space is provided between the radiation boiler and the wall surface of the slag separation chamber, and the gas which has descended in the radiation boiler is turned over and allowed to ascend behind the radiation boiler. Therefore, the radiation boiler has an increased area for heat transfer to increase the amount of recovered steam and also to increase a temperature drop of the gas.

(4) The lower end of the radiation boiler is submerged in water for blowing gas and slag into the water to quench them.

(5) A swirling flow of gaseous materials is created, and oxygen is supplied to an outer circumferential portion of the swirling flow, thereby increasing a gasification conversion ratio of particulate combustibles.

(6) The swirling flow of gaseous materials is formed inwardly in spaced relation to an inner wall surface of the combustion chamber for thereby reducing damage to the inner wall surface.

Industrial Applicability

According to the present invention, wastes such as municipal wastes, plastic wastes or coal, and combustibles are gasified, and gas generated by gasification is utilized for chemical industry or utilized as fuel.

What is claimed is:

1. An apparatus for gasifying wastes, said apparatus comprising:

a fluidized-bed gasification furnace to gasify at least one waste selected from the group consisting of municipal waste, refuse-derived fuel, plastic waste, FRP waste, biomass waste, and automobile waste at a temperature of from 550° C. to 850° C., to thereby generate combustible gas containing char; and a swirling melting furnace to gasify the combustible gas and char generated in said fluidized-bed gasification furnace at a temperature of from 1200° C. to 1600° C., said swirling melting furnace comprising:

a combustion chamber having an internal width dimension;

an introduction section to receive the combustible gas and char from said fluidized-bed gasification furnace and to form in said introduction section a swirling flow of the combustible gas and char including a concentrated cylindrical layer of char, said introduction section being integral with said combustion chamber and positioned above and coaxial therewith, and said introduction section having an internal width dimension smaller than said internal width dimension of said combustion chamber such that the swirling flow of combustible gas and char including the concentrated cylindrical layer of char is supplied from said introduction section into said combustion chamber and maintained therein;

blowing nozzles, in said combustion chamber at a position below said introduction section, to blow an oxygen-containing gas tangentially toward the concentrated cylindrical layer of char in said combustion chamber, thereby to gasify efficiently the char as well as the combustible gas, to generate a further combustible gas composed primarily of $H_2$ and CO, and to generate slag from incombustible portions of the char;

a slag separation chamber connected to a lower portion of said combustion chamber to cool and separate the slag generated in said combustion chamber; and a discharge to discharge the further combustible gas from said swirling melting furnace.

2. An apparatus as claimed in claim 1, wherein said combustion chamber and said introduction section have cylindrical interiors, and said internal width dimensions thereof comprise diameters.

3. An apparatus as claimed in claim 1, wherein said internal width dimension of said introduction section is ¼ to ¾ of said internal width dimension of said combustion chamber.

4. An apparatus as claimed in claim 1, wherein said blowing nozzles are operable to blow, as said oxygen-containing gas, a gas selected from the group consisting of air, oxygen-enriched air, oxygen to which steam has been added, and oxygen to which carbon dioxide has been added.

5. An apparatus as claimed in claim 1, wherein said slag separation chamber has a radiation boiler, such that the further combustible gas and the slag generated in said combustion chamber flow downwardly in said radiation boiler.

6. An apparatus as claimed in claim 1, wherein said slag separation chamber has a gas guide tube, such that the further combustible gas and the slag generated in said combustion chamber flow downwardly in said gas guide tube.

7. An apparatus as claimed in claim 1, wherein said discharge is positioned to discharge the further combustible gas after passage thereof through said slag separation chamber.

8. A method for gasifying wastes, said method comprising:

gasifying, in a fluidized-bed gasification furnace and at a temperature of from 550° C. and 850°C., at least one waste selected from the group consisting of municipal waste, refuse-derived fuel, plastic waste, FRP waste, biomass waste, and automobile waste, to thereby generate combustible gas containing char;

introducing said combustible gas and char generated in said fluidized-bed gasification furnace into an introduction section of a swirling melting furnace and forming in said introduction section a swirling flow of said combustible gas and char including a concentrated cylindrical layer of char;

supplying said combustible gas and char from said introduction section downwardly into a combustion chamber that is located below and that is integral and coaxial with said introduction section, with said combustion chamber having an internal width dimension that is larger than an internal width dimension of said introduction section, while maintaining within said combustion chamber said swirling flow of said combustible gas and char including said concentrated cylindrical layer of char;

supplying an oxygen-containing gas, from blowing nozzles in said combustion chamber at a position below said introduction section, tangentially toward said concentrated cylindrical layer of char in said combustion chamber, thereby gasifying efficiently said char as well as said combustible gas at a temperature of from 1200° C. to 1600° C., and thus generating a further combustible gas composed primarily of $H_2$ and CO and generating slag from incombustible portions of said char;

cooling and separating said slag generated in said combustion chamber in a slag separation chamber connected to a lower portion of said combustion chamber; and discharging said further combustible gas from said swirling melting furnace.

9. A method as claimed in claim 8, wherein said combustion chamber and said introduction section have cylindrical interiors, and said internal width dimensions thereof comprise diameters.

10. A method as claimed in claim 8, wherein said internal width dimension of said introduction section is ¼ to ¾ of said internal width dimension of said combustion chamber.

11. A method as claimed in claim 8, wherein said oxygen-containing gas comprises a gas selected from the group consisting of air, oxygen-enriched air, oxygen to which steam has been added, and oxygen to which carbon dioxide has been added.

12. A method as claimed in claim 8, wherein said slag separation chamber has a radiation boiler, and further comprising flowing said further combustible gas and said slag generated in said combustion chamber downwardly in said radiation boiler.

13. A method as claimed in claim 8, wherein said slag separation chamber has a gas guide tube, and further comprising flowing said further combustible gas and said slag generated in said combustion chamber downwardly in said gas guide tube.

14. A method as claimed in claim 8, wherein said discharging comprises discharging said further combustible gas after passage thereof through said slag separation chamber.

15. A swirling melting furnace for gasifying combustible gas and char that have been generated in a fluidized-bed gasification furnace by gasifying at least one waste selected from the group consisting of municipal waste, refuse-derived fuel, plastic waste, FRP waste, biomass waste, and automobile waste at a temperature of from 550° C. to 850° C., to thereby generate the combustible gas and char, said swirling melting furnace comprising:

a combustion chamber having an internal width dimension;

an introduction section to receive the combustible gas and char from the fluidized-bed gasification furnace and to form in said introduction section a swirling flow of the combustible gas and char including a concentrated cylindrical layer of char, said introduction section being integral with said combustion chamber and positioned above and coaxial therewith, and said introduction section having an internal width dimension smaller than said internal width dimension of said combustion chamber such that the swirling flow of combustible gas and char including the concentrated cylindrical layer of char is supplied from said introduction section into said combustion chamber and maintained therein;

blowing nozzles, in said combustion chamber at a position below said introduction section, to blow an oxygen-containing gas tangentially toward the concentrated cylindrical layer of char in said combustion chamber, thereby to gasify efficiently the char as well as the combustible gas at a temperature of from 1200° C. to 1600° C., to generate a further combustible gas composed primarily of $H_2$ and CO, and to generate slag from incombustible portions of the char;

a slag separation chamber connected to a lower portion of said combustion chamber to cool and separate the slag generated in said combustion chamber; and a discharge to discharge the further combustible gas from said swirling melting furnace.

16. A furnace as claimed in claim 15, wherein said combustion chamber and said introduction section have cylindrical interiors, and said internal width dimensions thereof comprise diameters.

17. A furnace as claimed in claim 15, wherein said internal width dimension of said introduction section is ¼ to ¾ of said internal width dimension of said combustion chamber.

18. A furnace as claimed in claim 15, wherein said blowing nozzles are operable to blow, as said oxygen-containing gas, a gas selected from the group consisting of air, oxygen-enriched air, oxygen to which steam has been added, and oxygen to which carbon dioxide has been added.

19. A furnace as claimed in claim 15, wherein said slag separation chamber has a radiation boiler, such that the further combustible gas and the slag generated in said combustion chamber flow downwardly in said radiation boiler.

20. A furnace as claimed in claim 15, wherein said slag separation chamber has a gas guide tube, such that the further combustible gas and the slag generated in said combustion chamber flow downwardly in said gas guide tube.

21. A furnace as claimed in claim 15, wherein said discharge is positioned to discharge the further combustible gas after passage thereof through said slag separation chamber.

22. A method for gasifying combustible gas and char that have been generated in a fluidized-bed gasification furnace by gasifying therein, at a temperature of from 550° C. and 850° C., at least one waste selected from the group consisting of municipal waste, refuse-derived fuel, plastic waste, FRP waste, biomass waste, and automobile waste, to thereby generate said combustible gas and char, said method comprising:

introducing said combustible gas and char into an introduction section of a swirling melting furnace and forming in said introduction section a swirling flow of said combustible gas and char including a concentrated cylindrical layer of char;

supplying said combustible gas and char from said introduction section downwardly into a combustion chamber that is located below and that is integral and coaxial with said introduction section, with said combustion chamber having an internal width dimension that is larger than an internal width dimension of said introduction section, while maintaining within said combustion chamber said swirling flow of said combustible gas and char including said concentrated cylindrical layer of char;

supplying an oxygen-containing gas, from blowing nozzles in said combustion chamber at a position below said introduction section, tangentially toward said concentrated cylindrical layer of char in said combustion chamber, thereby gasifying efficiently said char as well as said combustible gas at a temperature of from 1200° C. to 1600° C., and thus generating a further combustible gas composed primarily of $H_2$ and CO and generating slag from incombustible portions of said char;

cooling and separating said slag generated in said combustion chamber in a slag separation chamber connected to a lower portion of said combustion chamber; and discharging said further combustible gas from said swirling melting furnace.

23. A method as claimed in claim 22, wherein said combustion chamber and said introduction section have cylindrical interiors, and said internal width dimensions thereof comprise diameters.

24. A method as claimed in claim 22, wherein said internal width dimension of said introduction section is ¼ to ¾ of said internal width dimension of said combustion chamber.

25. A method as claimed in claim 22, wherein said oxygen-containing gas comprises a gas selected from the group consisting of air, oxygen-enriched air, oxygen to which steam has been added, and oxygen to which carbon dioxide has been added.

26. A method as claimed in claim 22, wherein said slag separation chamber has a radiation boiler, and further comprising flowing said further combustible gas and said slag generated in said combustion chamber downwardly in said radiation boiler.

27. A method as claimed in claim 22, wherein said slag separation chamber has a gas guide tube, and further comprising flowing said further combustible gas and said slag generated in said combustion chamber downwardly in said gas guide tube.

28. A method as claimed in claim 22, wherein said discharging comprises discharging said further combustible gas after passage thereof through said slag separation chamber.

* * * * *